US007775733B2

(12) United States Patent
Noda et al.

(10) Patent No.: US 7,775,733 B2
(45) Date of Patent: Aug. 17, 2010

(54) METHOD FOR PROCESSING MEDIUM, IMAGE PROCESSING APPARATUS, AND PRINTER APPARATUS

(75) Inventors: Yasuo Noda, Fukushima-ken (JP); Hiroaki Ono, Fukushima-ken (JP); Hironobu Sakai, Fukushima-ken (JP); Naoki Sato, Fukushima-ken (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 12/173,965

(22) Filed: Jul. 16, 2008

(65) Prior Publication Data

US 2008/0279571 A1 Nov. 13, 2008

Related U.S. Application Data

(62) Division of application No. 10/925,431, filed on Aug. 25, 2004, now Pat. No. 7,410,317.

(30) Foreign Application Priority Data

Aug. 26, 2003 (JP) ..... 2003-208854

(51) Int. Cl.
*B41J 29/00* (2006.01)

(52) U.S. Cl. ..... 400/709; 400/59; 400/320; 400/708

(58) Field of Classification Search ..... 400/579, 400/580, 582, 630, 708, 708.1, 709, 55, 59, 400/60, 320
See application file for complete search history.

(56) References Cited

U.S. PATENT DOCUMENTS

| | | | |
|---|---|---|---|
| 4,179,223 | A | 12/1979 | Kwan et al. |
| 5,021,676 | A | 6/1991 | Dragon et al. |
| 5,076,566 | A | 12/1991 | Kriegel |
| 5,173,953 | A | 12/1992 | Wataya et al. |
| 5,184,904 | A | 2/1993 | Hara et al. |
| 5,323,176 | A | 6/1994 | Sugiura et al. |
| 5,427,366 | A | 6/1995 | Sakamori |
| 5,443,257 | A | 8/1995 | Sakamori |
| 5,564,848 | A | 10/1996 | Quintana |
| 5,604,568 | A | 2/1997 | Iwama |
| 5,680,168 | A | 10/1997 | Kokubo et al. |
| 5,895,928 | A | 4/1999 | Kerschner |
| 6,078,678 | A | 6/2000 | Gavrilos |

(Continued)

FOREIGN PATENT DOCUMENTS

JP 01087289 A * 3/1989

(Continued)

*Primary Examiner*—Ren Yan
(74) *Attorney, Agent, or Firm*—Panitch Schwarze Belisario & Nadel LLP

(57) ABSTRACT

A printer apparatus is disclosed. The printer includes a medium feeding passage for conveying a medium; print head for performing a spacing and for performing a printing processing on the medium; a detector for detecting a first end position in a widthwise direction of the medium at a first position in a medium conveyance direction and for detecting a second end position in the widthwise direction of the medium at a second position in the medium conveyance direction; and a comparator for comparing the first end position with the second end position detected with the detector. The control of the print head is performed according to the compared result from the comparator.

8 Claims, 27 Drawing Sheets

U.S. PATENT DOCUMENTS

| | | | |
|---|---|---|---|
| 6,126,347 | A | 10/2000 | Sakaino et al. |
| 6,139,128 | A | 10/2000 | Magirl et al. |
| 6,276,778 | B1 | 8/2001 | Katayama |
| 6,305,856 | B1 | 10/2001 | Miyazaki |
| 6,352,332 | B1 | 3/2002 | Walker |
| 6,435,641 | B1 | 8/2002 | Tung et al. |
| 6,439,786 | B1 | 8/2002 | Hasiuk |
| 6,680,743 | B2 | 1/2004 | Kapushinski et al. |
| 6,788,322 | B2 | 9/2004 | Morita |
| 6,845,288 | B2 | 1/2005 | Pierel et al. |
| 2002/0110398 | A1 | 8/2002 | Park |
| 2003/0039499 | A1 | 2/2003 | Kelley et al. |
| 2004/0028450 | A1 | 2/2004 | Jung |
| 2005/0012259 | A1 | 1/2005 | Sano et al. |

FOREIGN PATENT DOCUMENTS

| | | | | |
|---|---|---|---|---|
| JP | 02-243376 | A | | 9/1990 |
| JP | 02239058 | A | * | 9/1990 |
| JP | 05-124282 | A | | 5/1993 |
| JP | 06080277 | A | * | 3/1994 |
| JP | 11059975 | A | | 3/1999 |
| JP | 2002067446 | A | | 3/2002 |
| JP | 2002348023 | A | | 12/2002 |

* cited by examiner

METHOD FOR PROCESSING MEDIUM, IMAGE PROCESSING APPARATUS, AND PRINTER APPARATUS

CROSS-REFERENCE TO RELATED APPLICATIONS

This application is a Divisional of U.S. patent application Ser. No. 10/925,431, filed Aug. 25, 2004.

BACKGROUND OF THE INVENTION

This invention relates to a method for processing a medium, an image processing apparatus, for example such as a facsimile machine, and a photocopier, and a printer apparatus.

Conventionally, with a printer apparatus such as an impact dot printer, a ribbon mask for preventing a paper from staining is arranged between an ink ribbon situated on a front end of a print head and the paper as a medium, and ink from the ink ribbon is transferred through a hole formed at the ribbon mask to the paper.

With the conventional printer apparatus, however, a corner portion of the paper slides into the hole of the ribbon mask where printing operation is made from an upper end portion of the paper, so that obstructions such as a dog-eared paper, a paper travel jam, or spacing error may occur. Where the hole itself of the ribbon mask receives damages, rubbing of the ink ribbon or the damaged ribbon mask against the paper occurs during the subsequent printing operation, so that print quality may be deteriorated.

FIG. 2 is a plan view showing operation of medium conveyance according to the conventional printer apparatus; FIG. 3 is a side view showing the operation of the medium conveyance according to the conventional printer apparatus; FIG. 4 is a view showing a curl of the medium according to the conventional printer apparatus.

In drawings, numeral 41 is the paper as the medium, and during the printing operation, the paper 41, with the printer apparatus, is supplied from a paper supply opening, not shown, at a front side of a delivery route (a right side in FIG. 3), and passes over a table 45 to detect the setting by a table sensor 34. The paper 41, subsequently, is conveyed through a paper guide 42 on an upstream side by means of rotating a feed roller 44. At this moment, a skew sensor 33 judges as to whether the upper end of the paper 41 is horizontally supplied, and where the upper end of the paper 41 is horizontally supplied, the paper is further conveyed onto a platen 46. It is to be noted that the skew sensors and the table sensors are respectively arranged in a plural number.

A paper width sensor 32 arranged above the platen 46 confirms a position of the paper 41 by means of detecting left and right ends of the paper 41, and when the position of the paper 41 is confirmed, print data are printed by the print head 21. The printed paper 41 is conveyed to the paper guide 43 on a downstream side and is discharged from a discharge opening, not shown, at a back side of the delivery route (a left side in FIG. 3).

Herein, where the printing operation is made from the upper end portion of the paper 41, the corner portion of the paper 41 slides into the hole of the ribbon mask, not shown, so that there is a problem that obstructions such as the dog-eared paper, the paper travel jam, or spacing error may occur. Another problem exists such that where the hole itself of the ribbon mask receives damages, rubbing of the ink ribbon or the damaged ribbon mask against the paper 41 occurs during the subsequent printing operation, so that the print quality deteriorates.

The problems like the above tend to be more outstanding especially where the front end of the paper 41, as shown in FIG. 4, is curled (curved) upward. FIG. 4 (*a*) shows a large curling state, and FIG. 4 (*b*) shows a small curling state. Additionally, where the front end of the paper 41 is curled, while the paper 41 is conveyed, as shown in FIG. 3, the front end of the paper 41 engages with the front end of the paper guide 43 arranged on the downstream side with respect to a printing position in entering into the above paper guide 43 on the downstream side, so that there has been such a problem that the paper travel jam easily occurs. Furthermore, with the printer apparatus having the paper width sensor 32 serving for a paper width detection function, when the paper width is detected, a left end position of the paper 41 cannot be accurately detected because of the curl of the front end of the paper 41, so that such a problem may occur that a print format becomes misaligned during the subsequent printing operation.

To solve the aforementioned problems, a printer apparatus has been proposed, e.g., such as described in Japanese Patent Application Publication No. JA-5-124282, wherein one paper guide is arranged on the upstream and the downstream sides respectively with respect to the printing position, and further, a paper holding plate is arranged between two paper guides for controlling the paper from above, and thereby preventing front end and the distal end of the paper from curling.

With the above described conventional printer apparatus, however, the structure becomes complicated because particular machinery such as the paper holding plate is equipped, so that a whole printer apparatus costs so greatly.

It is an object of this invention to solve the aforementioned problems of the conventional printer apparatus and to provide a medium detecting method, an image processing apparatus, and a printer apparatus for detecting folding of the medium by detecting the medium width at first and second positions to make printing suitably corresponding to folding of the medium.

BRIEF SUMMARY OF THE INVENTION

A first end position in a widthwise direction of a medium at a first position in a lengthwise direction of the medium, while a second end position in the widthwise direction of the medium at a second position in the lengthwise direction of the medium, and a comparison of the detected first end position with the detected second end position is performed to make predetermined processing according to the compared result.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
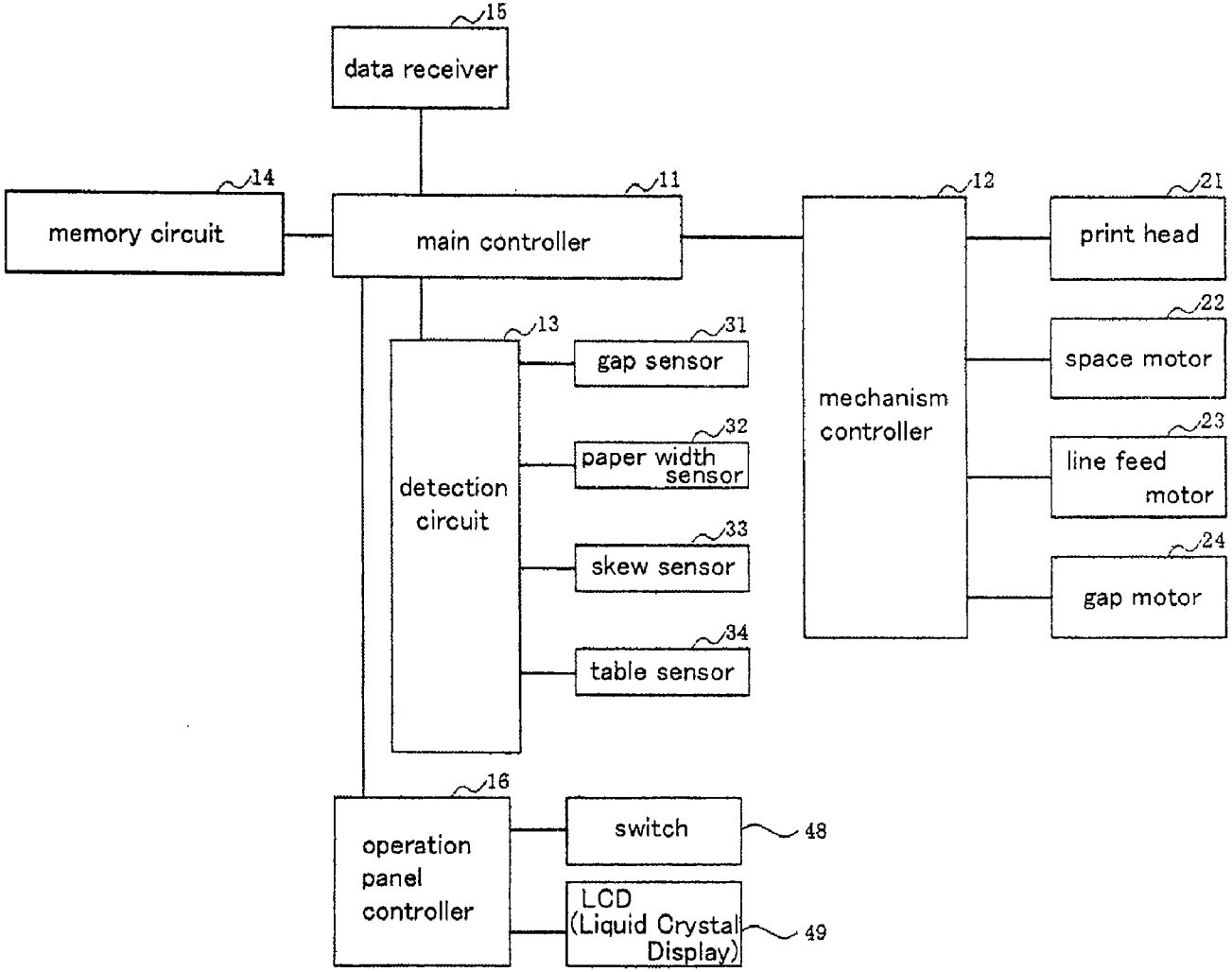
FIG. 1 is a block diagram showing a structure of a printer apparatus according to the first embodiment of the invention.

FIG. 1 is a block diagram showing a structure of a printer apparatus according to the first embodiment of the invention. Hereinafter, printer apparatuses are exemplified as embodiments of the invention, but the image processing apparatus according to the invention is applicable to facsimile machines, photocopiers, and other computer-related devices having a paper feeding mechanism. The image processing apparatus according to the invention can be a part of an entire apparatus.

In drawings, numeral 15 is a data receiver for receiving data and for transmitting or receiving a control signal from a host apparatus, not shown. Numeral 11 is a main controller for receiving control data, print data, and the control signal from the host apparatus through the data receiver 15, thereby interpreting and making an extension to an image buffer the received control data, the print data, and the control signal. It is to be noted that explanation of the printer apparatus according to "description of related arts", shown in FIG. 2 and FIG. 3 is quoted for the structure of the printer apparatus according to this embodiment.

Figure 2:
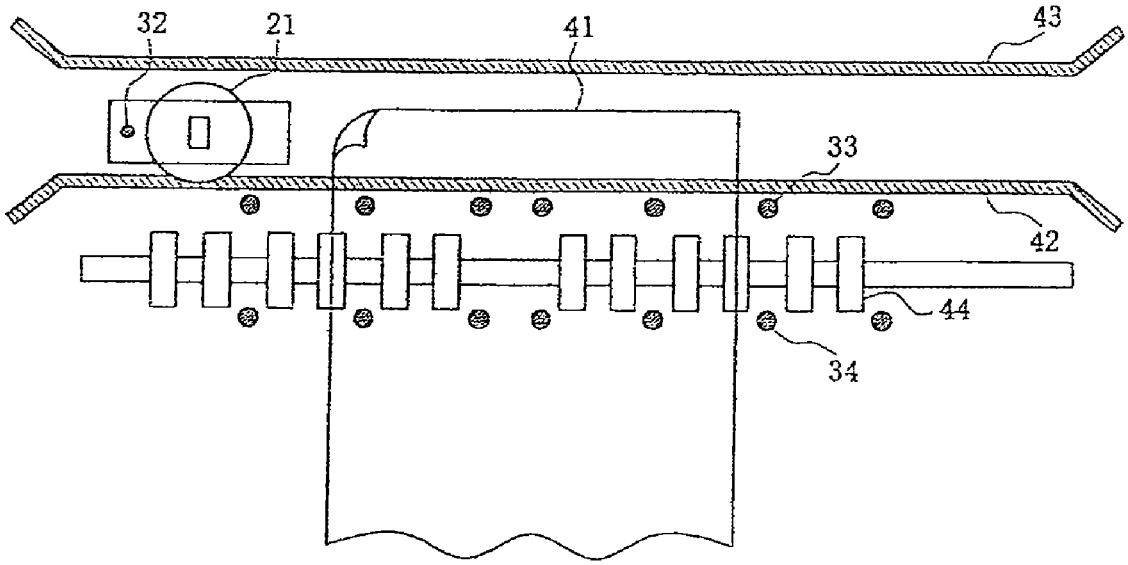
FIG.2 PRIOR ART
FIG. 2 is a plan view showing operation of medium conveyance of a conventional printer apparatus.
Figure 3:
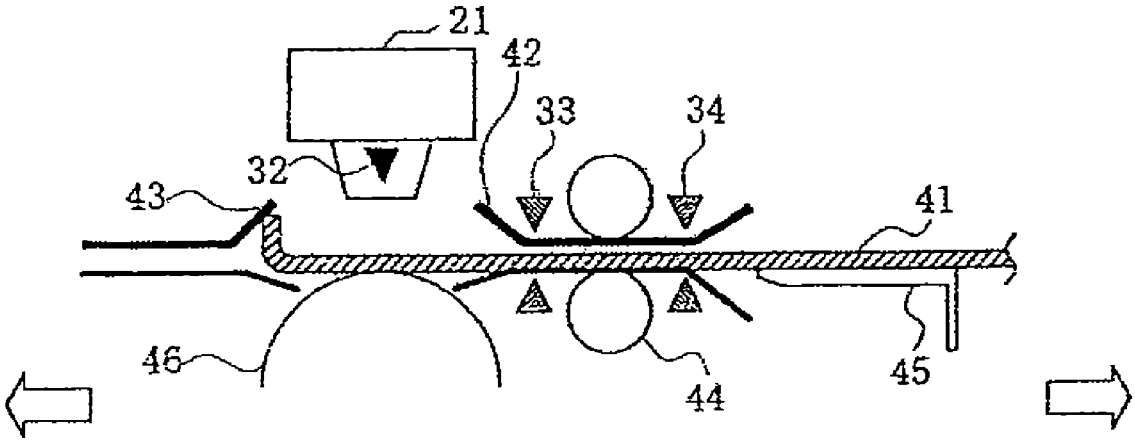
FIG.3 PRIOR ART
FIG. 3 is a side view showing the operation of the medium conveyance of the conventional printer apparatus.
Figure 4A:
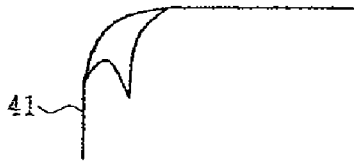
FIG.4a PRIOR ART
FIGS. 4(*a*) and 4(*b*) is a view showing curling of the medium of the conventional printer apparatus.
Figure 4B:
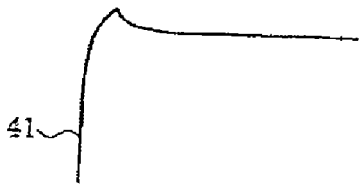
FIG.4b PRIOR ART

That is, as shown in FIG. 2 and FIG. 3, numeral 41 is the paper as the medium, and during the printing operation, the paper 41, with the printer apparatus, is supplied from a paper supply opening, not shown, at a front side of a delivery route (a right side in FIG. 3), and passes over a table 45 to detect the setting by a table sensor 34. The paper 41, subsequently, is conveyed through a paper guide 42 on an upstream side by means of rotating a feed roller 44. At this moment, a skew sensor 33 judges as to whether the upper end of the paper 41 is horizontally supplied, and where the upper end of the paper 41 is horizontally supplied, the paper is further conveyed onto a platen 46. It is to be noted that the skew sensors and the table sensors are respectively arranged in a plural number.

A paper width sensor 32 arranged above the platen 46 confirms a position of the paper 41 by means of detecting left and right ends of the paper 41, and when the position of the paper 41 is confirmed, print data are printed by the print head 21. The printed paper 41 is conveyed to the paper guide 43 on a downstream side and is discharged from a discharge opening, not shown, at a back side of the delivery route (a left side in FIG. 3).

Numeral 12 is a mechanism controller having a plurality of dot pins and controlling operations of: a print head 21 serving as a printing portion for printing predetermined dot patterns produced by the main controller 11; a space motor 22 for shifting the print head 21 in a widthwise direction; a line feed motor 23 for conveying a paper 41 as a medium in a vertical direction and operating a line feed; and a gap motor 24 for widening and narrowing a space between the paper 41 and the print head 21, i.e., a head gap.

Numeral 13 is a detection circuit for receiving the signals from: a gap sensor 31 at a carriage having the print head 21, for measuring the space between the paper 41 and the print head 21 to obtain the suitable head gap during a printing operation; a paper width sensor 32 for measuring a width of the loaded paper 41 to grasp a paper position; a skew sensor 33 for detecting an upper and a lower end positions of the loaded paper 41; and a table sensor 34 for recognizing the paper 41 mounted on the table 45.

With the structure of the printer apparatus according to this embodiment, such a printer apparatus is targeted, that where the paper is set within a predetermined range in a direction to a printer apparatus width, the paper 41 can be automatically supplied and printed. Therefore, a plurality of the skew sensors and the table sensors are respectively arranged with predetermined intervals in a paper width direction. The printer apparatus is thus structured to be able to detect, by the upper end position of the paper 41 detected with the skew sensor 33 during paper feeding, as to whether the supplied paper 41 is skewed.

Numeral 14 is a memory circuit for storing the print data transmitted from the main controller 11 and serving as a buffer memory to make an extension operation in the image buffer as to print the print data. The memory circuit 14 stores, e.g., information on the head gap, information on the paper width, and information on a paper length obtained in the detection circuit 13. Furthermore, the memory circuit 14 has a nonvolatile memory such as an EEPROM (Electrically Erasable and Programmable Read-Only-Memory) storing a print start position, a medium mode, or the like set in a set-up mode.

Numeral 16 is a operation panel controller including a switch 48 as an input means and LCD (Liquid Crystal Display) 49 as a display means. By a user's control of the switch 48, the operation panel controller 16 gives an instruction for changing to each of control modes, an instruction for feeding or discharging of the paper 41, or the like, thereby operating an interface between the user and the printer apparatus. From the printer apparatus to the user, the LCD 49 displays center information, a warning, an error, or the like of the printer apparatus.

Next, firmware control will be explained.

Figure 5:
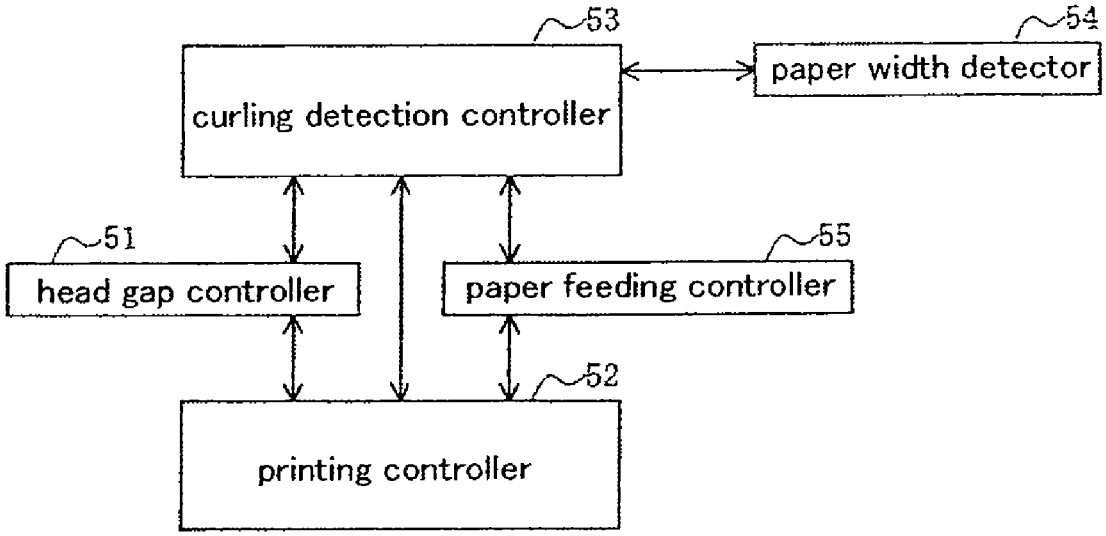
FIG. 5 is a block diagram showing firmware control according to the first embodiment of the invention.

FIG. 5 is a block diagram showing the firmware control according to the first embodiment of the invention.

In FIG. 5, numeral 51 is a head gap controller for operating the gap motor 24 before detecting the paper width to make widening operation of the print head 21 and the paper width sensor 32 mounted on the print head 21, i.e., operation to widen the head gap. The head gap controller 51 adjusts the space between the paper 41 and the print head 21 to the suitable position during the printing operation.

Numeral 54 is a paper width detector as a detector for shuttling or reciprocally moving the print head 21 in the paper 41 width direction by means of the space motor 22, and for detecting left and right end positions of the paper 41 with the paper width sensor 32 mounted on the print head 21.

Numeral 53 is a curling detection controller serving as a comparator for detecting folding of the medium, i.e., curling of the paper 41. The curling detection controller 53 judges according to the left and right end positions of the paper 41 detected in the paper width detector 54 as to whether the front end of the paper 41 is curled. In that event, the curling detection controller 53 functions as a comparator for the detected widths to compare the detected paper width positions at first and second times respectively, thereby being able to judge as to whether the front end of the paper 41 is curled.

Numeral 55 is a paper feeding controller for controlling a paper loading, a paper feeding, and a paper discharging be means of the line feed motor 23. The paper feeding controller 55, furthermore, monitors the table sensor 34 and the skew sensor 33 to grasp a setting condition of the paper 41, the upper and lower end positions of the paper 41, or the like.

Numeral 52 is a printing controller as a presswork controller for determining a printing direction according to a curling position detected by the curling detection controller 53 to execute the printing operation.

Hereinafter, operation of the printer apparatus structured like above will be explained. The operation of the curling detection controller 53 is explained first.

Figure 6:
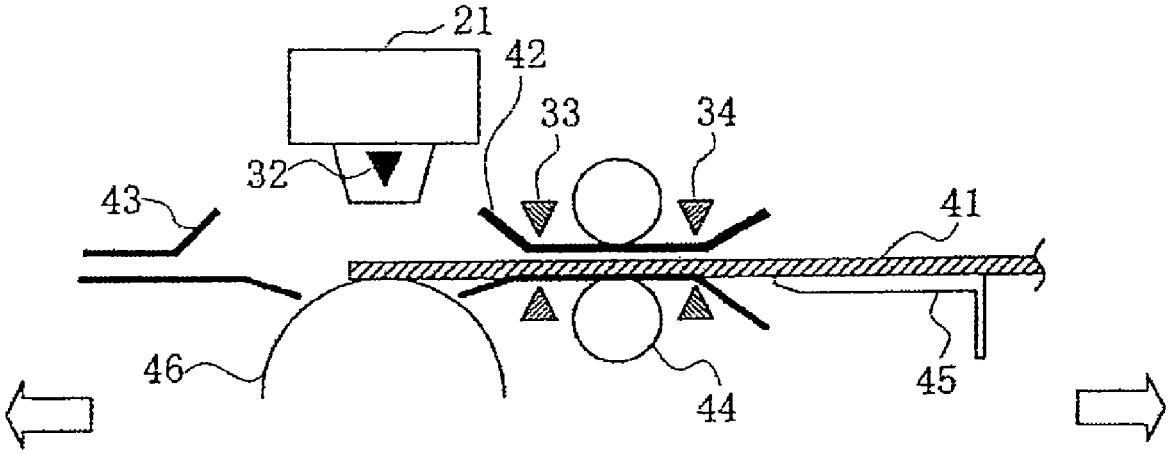
FIG. 6 is a first side view showing operation of a curling detection according to the first embodiment of the invention.
Figure 7:
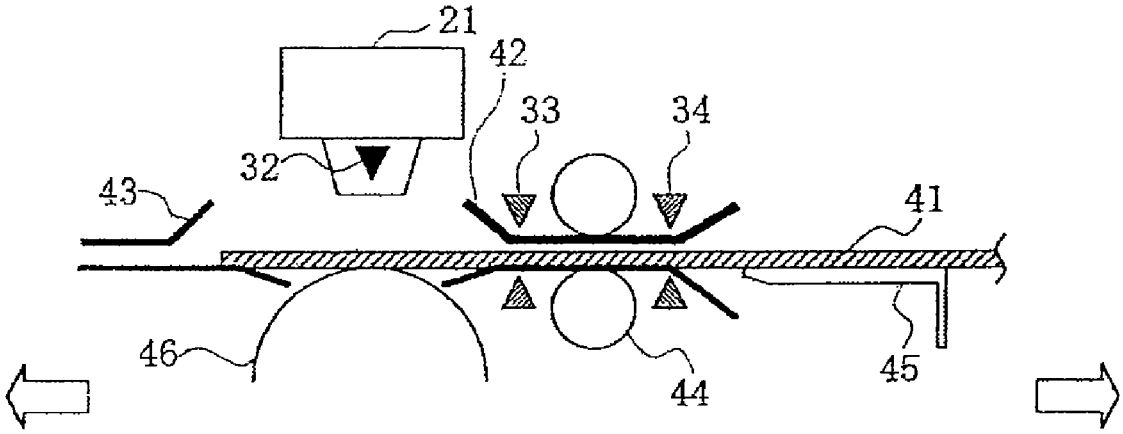
FIG. 7 is a second side view showing the operation of the curling detection according to the first embodiment of the invention.
Figure 8:
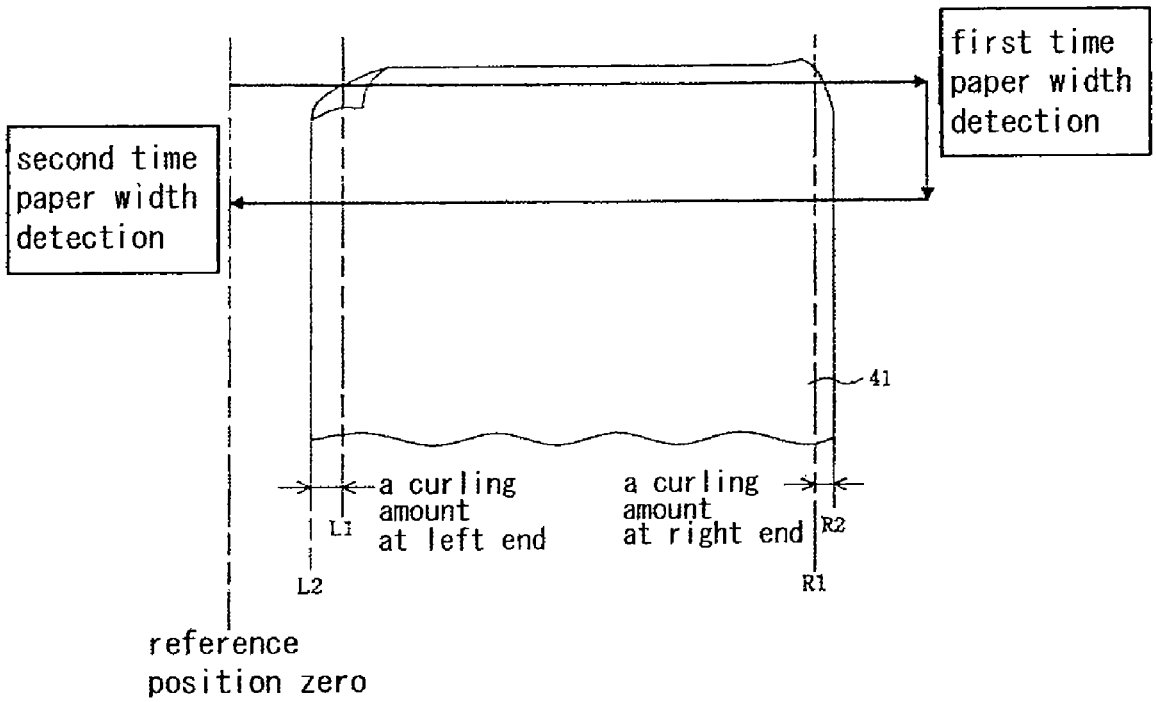
FIG. 8 is a plan view showing the operation of the curling detection according to the first embodiment of the invention.
Figure 9:
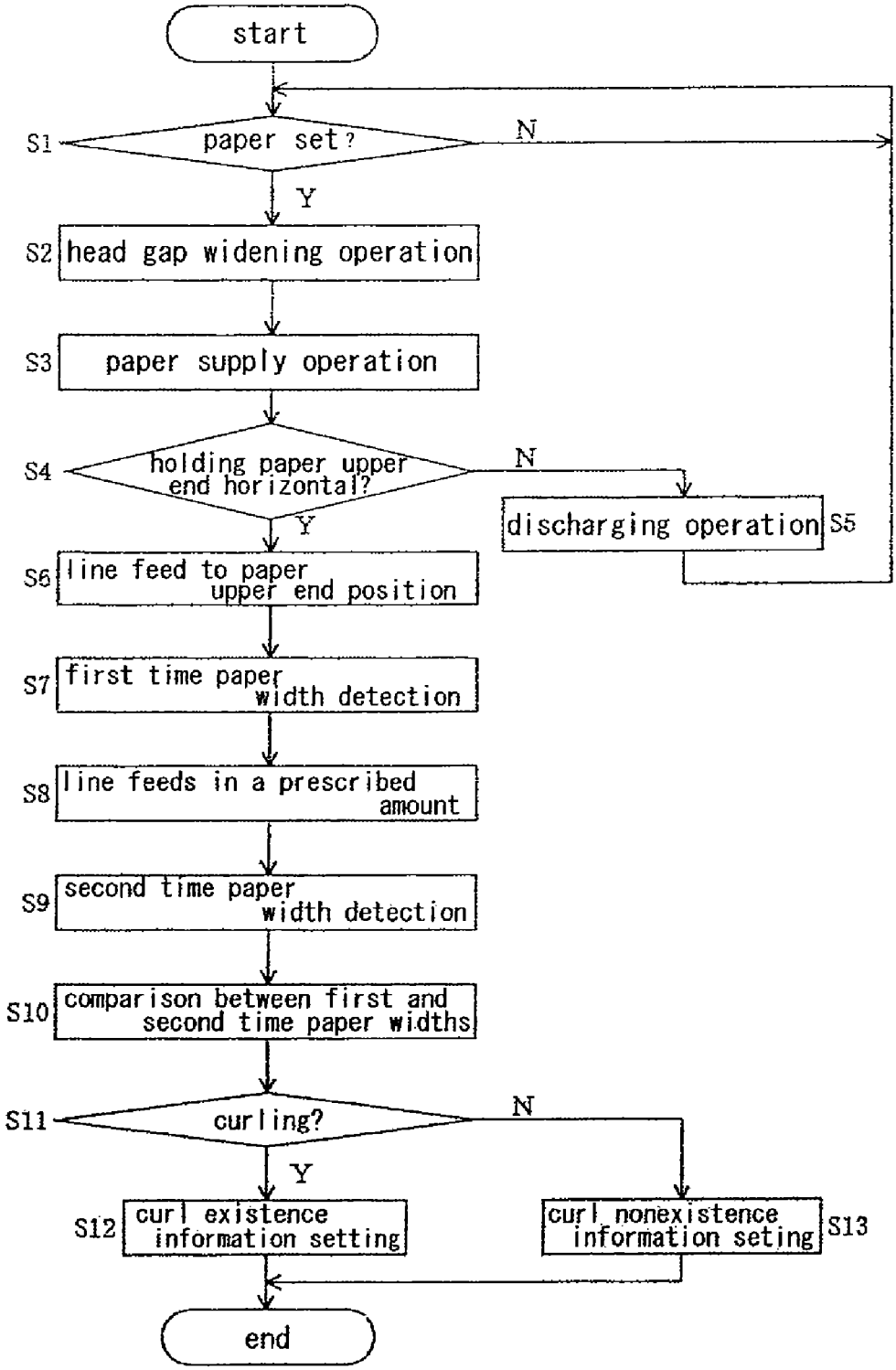
FIG. 9 is a flow chart showing operation of the curling detection controller according to the first embodiment of the invention.

FIG. 6 is a first side view showing the operation of the curling detection according to the first embodiment of the invention; FIG. 7 is a second side view showing the operation of the curling detection according to the first embodiment of the invention; FIG. 8 is a plan view showing the operation of the curling detection according to the first embodiment of the invention; and FIG. 9 is a flow chart showing the operation of a curling detection controller according to the first embodiment of the invention.

With the printer apparatus, where the printing operation is made, the paper 41 is supplied to the paper supply opening, not shown, to be conveyed over the table sensor 34 by the paper feeding controller 55. Furthermore, the judgment is made as to whether the paper 41 is set on the table sensor 34, and where the paper 41 is not yet set, the operation stays until the paper 41 is set. Where the judgment is made as that the paper 41 is set, the head gap controller 51 makes the gap motor 24 operate the widening operation of the head gap. More specifically, the operation to widen the head gap is made.

The paper 41 is supplied up to the skew sensor 33, so that the skew sensor 33 detects the upper end of the paper 41, and judgment is made as to whether the detected upper end of the paper 41 is horizontally supplied. Where the paper 41 is horizontally supplied, the paper 41 is conveyed up to a lower side position of the paper width sensor 32 after feeding lines. Where the upper end of the paper 41 is not in a widthwise condition because of, e.g., supplying of the paper 41 as skewed, the paper 41 is discharged, and a state that the paper 41 is in a skewed condition is displayed at a display screen made of the LCD 49 to inform the user.

As shown in FIG. 6, the paper width detector 54 reciprocally moves the print head 21 in the width direction of the paper 41 with the space motor 22 to operate the first the paper width detection at the first position with the paper width sensor 32 attached to the print head 21. In this situation, as shown in FIG. 8, the left and right end positions detected at the first time are respectively memorized as L1 and R1. The lines are fed in a predetermined amount up to a position such that the front end of the paper 41 does not pass over the paper guide on a downstream side with respect to a printing position. As shown in FIG. 7, the paper width detector 54 operates the second paper width detection at the second position with the paper width sensor 32. In this situation, as shown FIG. 8, the left and right end positions detected at the second time are respectively memorized as L2 and R2.

By comparing each of the left and right end positions of the paper 41 detected at the first and second time respectively with the paper width detector 54, the curling detection controller 53 judges as to whether the paper 41 is curled. More specifically, the curling detection controller 53 judges a curling status in comparing the left end position at the first time L1 and the right end position at the first time R1 with the left end position at the second time L2 and the right end position at the second time R2. As shown FIG. 8, the leftmost position of a head spacing operation range is defined as a reference position zero. Herein, where following Expression (1) is satisfied, the left end of the paper 41 is judged as curled, and the curling amount of the left end of the paper 41 is calculated by following Expression (2). Furthermore, where following Expression (3) is satisfied, the left end of the paper 41 is judged as not curled.

The left end position at the first time L1>the left end position at the second time L2 — Expression (1)

The curling amount at the left end=$L1-L2$ — Expression (2)

The left end position at the first time L1 ≦the left end position at the second time L2 — Expression (3)

Where following Expression (4) is satisfied, the right end of the paper 41 is judged as curled, and the curling amount is calculated by following Expression (5). Furthermore, where following Expression (6) is satisfied, the right end of the paper 41 is judged as not curled.

The first right end position R1<the second right end position R2 — Expression (4)

The curling amount at the right end=$R2-R1$ Expression (5)

The first right end position R1≧the second right end position R2 Expression (6)

Where both of the left and right ends of the paper 41 are curled, the curling amounts at the right and the left ends are compared in size, and the position with the larger curling amount is defined as the curling position. The status that either of the left end or the right end of the paper 41 is curled is set, and this processing ends. Where neither the left end nor the right end of the paper 41 is curled, the status of curl nonexistence is set in paper curling status information, and this processing ends.

Hereinafter, a flow chart will be explained. At the step S1, the judgment is made as to whether the paper 41 is set on the table sensor 34. Where the paper 41 is set on the table sensor 34, the operation goes to the step S2, and where the paper 41 is not set on the table sensor 34, the operation stays standby state. The widening operation of the head gap is done at the step S2. The paper supply operation is done at the step S3. At the step S4, the judgment is made as to whether the upper end of the paper 41 is horizontally supplied. Where the upper end of the paper 41 is horizontally supplied, the operation goes to the step S6, and where the paper 41 is not horizontally supplied, the operation goes to the step S5. Discharging operation is done at the step S5. Line feeding is done up to the upper end position of the paper 41 at the step S6. The paper width detection operation at the first time is performed at the step S7. The line feeding in the prescribed amount is operated at the step S8. The paper width detection operation at the second time is performed at the step S9. The paper widths at the first and second times respectively are compared at the step S10. At the step S11, the judgment is made as to whether either of the left end and the right end of the paper 41 is curled. Where either of the left end and the right end of the paper 41 is curled, the operation goes to the step S12, and where neither of the left end and the right end of the paper 41 is curled, the operation goes to the step S13. At the step S12, the status that the paper 41 is curled is set, and this processing ends. At the step S13, the status that the paper 41 is not curled is set, and this processing ends.

Operation of the printing controller 52 is explained next.

Figure 10:
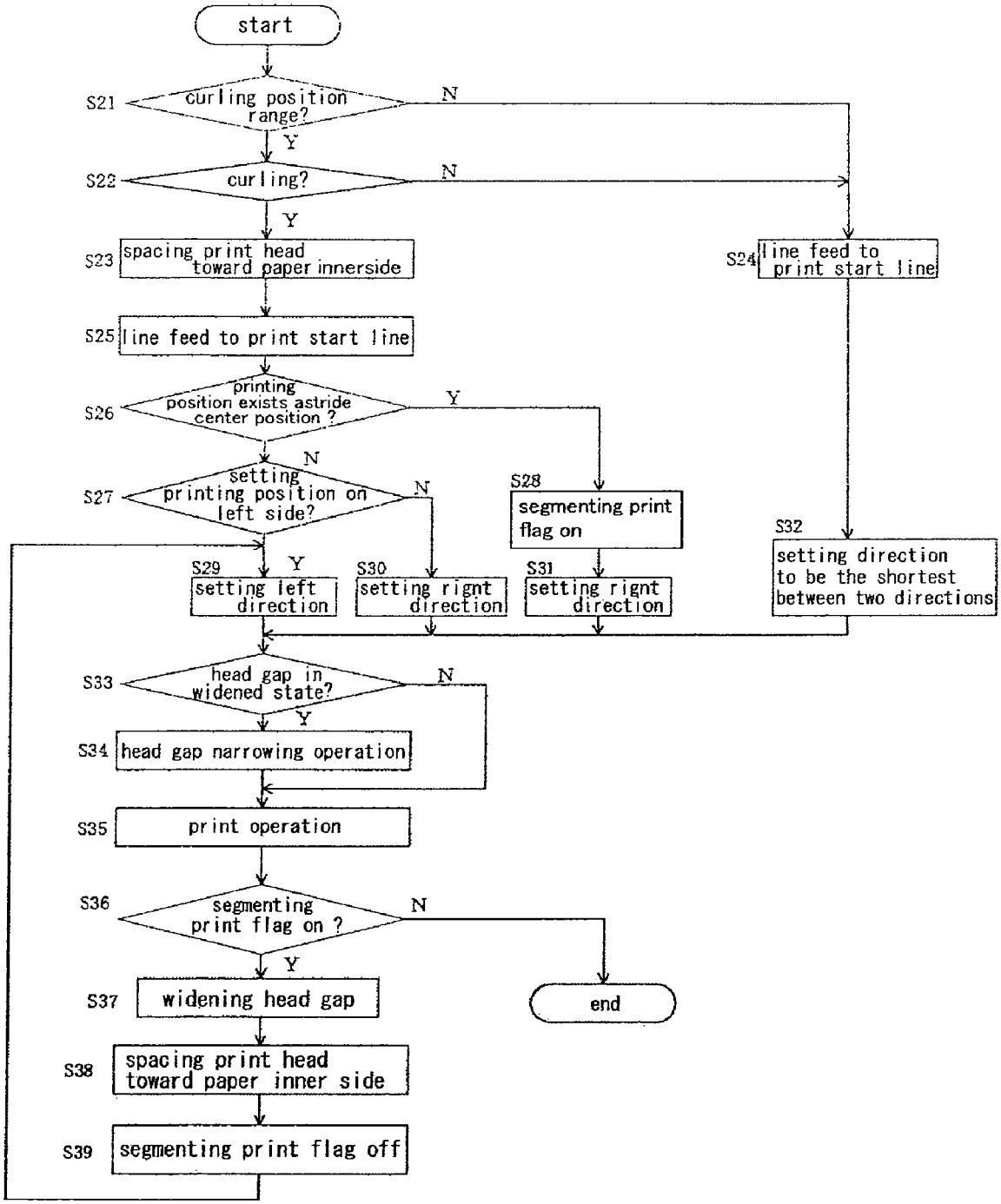
FIG. 10 is a flow chart showing operation of a printing controller according to the first embodiment of the invention.

FIG. 10 is a flow chart showing the operation of the printing controller according to the first embodiment of the invention.

When the data receiver 15 receives the print data and the line feed data from the host apparatus, not shown, the main controller 11 performs a data analysis to store the data in the image buffer, before transmits a print request to the mechanism controller 12. The judgment, subsequently, is made as to whether the position of the print data to be printed subsequently is within the range of the curling position at the upper end of the paper 41. Herein, the range of the curling position is defined as an arbitrary range with respect to the upper end of the paper 41. Where the printing operation is made at the position over the range of the curling position, the paper 41 is conveyed up to a print start line to operate the line feed, and the printing direction is set to a direction in which the printing operation is made from an end portion of a printing area with the shortest distance to the present position of the print head 21.

Where the printing operation is made within the range of the curling position, according to the paper curling status information set by the curling detection controller 53, the judgment is made as to whether the paper 41 is curled. Where the paper 41 is not curled, the paper 41 is conveyed up to the print start line to operate the line feed, and the printing direction is set to be the shortest to the present position of the print head 21. Where the paper 41 is curled, the paper width detector 54 operates the space motor 22 to make a spacing operation of the print head 21 up to the 12 position of an inner side of the paper 41. The paper 41 is then conveyed up to the print start line to operate the line feed.

The printing direction, subsequently, is to be set. The judgment is first made as to whether the printing position exists astride the center portion of the paper 41. Where the printing position does not exist astride the center portion of the paper 41, the judgment is further made as to whether the printing position is situated at the left side with respect to the center of the paper 41. Where the printing position is situated at the left end side, the printing direction is set to left (the printing operation in the direction to the curl), and where the printing position is not situated at the left end side, the printing direction is set to right (the printing operation in the opposite direction with respect to the curl). As described above, the judgment is made as to whether the printing position exists astride the center portion of the paper 41, and where the printing position exists astride the center portion of the paper 41, a segmenting print flag for segmenting the printing operation into two operations is turned on. Furthermore, the printing direction is set to right.

The judgment is subsequently made as to whether the head gap is in a widened state. Where the head gap is in the widened state, the gap motor 24 and the gap sensor 31 operate the print head 21 up to the position suitable for the printing operation, i.e., narrowing operation of the head gap. The printing operation of the print data is then made. Where the head gap is not in the widened state, the printing of the print data is operated with the head gap as it is. In this situation, the paper width detections of the first and second times respectively may be operated again after the range of the curling position is printed. Neither any discharge nor the error of the paper 41 is therefore made even where more than the predetermined curls occur. The judgment is further made as to whether the segmenting print flag is turned on. Where the segmenting print flag is not turned on, the operation ends, and where the segmenting print flag is turned on, the head gap is made in the widened state, and the spacing operation of the print head 21 is made toward the inner side of the paper 41. The segmenting print flag is then turned off, and the printing direction is set to left, so a subsequent operation returns to a step to make the printing operation. After the operation of the head gap, the printing operation is made from the center portion toward the left end portion of the paper 41. The printing operation is then made over because the segmenting print flag is turned off.

A flow chart will be hereinafter explained. At the step S21, the judgment is made as to whether the position of the print data is situated within the range of the curling position. Where the position of the print data is situated within the range of the curling position, the operation goes to the step S22, and where the position of the print data is situated out of the range of the curling position, the operation goes to the step S24. The judgment is made at the step S22 as to whether the paper 41 is curled. Where the paper 41 is curled, the operation goes to the step S23, and where the paper 41 is not curled, the operation goes to the step S24. At the step 23, the spacing operation of the print head 21 is made up to the center position of the inside of the paper 41. The paper 41 is conveyed up to the print start line to operate the line feed at the step S24. The paper 41 is conveyed up to the print start line, and the line feed is operated at the step S25. The judgment is made at the step S26 as to whether the printing position exists astride the center portion of the paper 41. Where the printing position does not exist astride the center portion of the paper 41, the operation goes to the step S27, and where the printing position exists astride the center portion of the paper 41, the operation goes to the step S28. The judgment is made at the step S27 as to whether the printing position is situated at a left end side. Where the printing position is situated at the left end side, the operation goes to the step S29, and where the printing position is not situated at the left end side, the operation goes to the step S30. The segmenting print flag is turned on at the step S28. The printing direction is set to left at the step S29. The printing direction is set to right at the step S30. The printing direction is set to right at the step S31. At the step S32, the printing direction is set to the direction in which the printing operation is made from the end portion of the printing area with the shortest distance to the present position of the print head 21. The judgment is made at the step S33 as to whether the head gap is in the widened state. Where the head gap is in the widened state, the operation goes to the step S34, and where the head gap is not in the widened state, the operation goes to the step S35. The narrowing operation of the head gap is made at the step S34. At the step S35, the printing operation of the print data is made. The judgment is made at the step S36 as to whether the segmenting print flag is turned on. Where the segmenting print flag is turned on, the operation goes to the step S37, and where the segmenting print flag is not turned on, this processing ends. The widening operation of the head gap is made at the step S 37. The spacing operation of the print head 21 is made toward the inner side of the paper 41 at the step S38. At the step S39, the segmenting print flag is turned off, and the operation returns to the step S29.

In this embodiment, like the above, with the printer apparatus with an ink ribbon system in which the ribbon mask is arranged between the ink ribbon situated at the front end of the print head 21 and the paper 41 so the ink from the ink ribbon is transferred through the hole formed at the ribbon mask to the paper 41, where the judgment is made as that the upper end of the paper 41 is in a curling condition, the printing operation is made from an inner side or center of the paper 41 to the outer end of the paper 41 as the curling position. Therefore, the hole of the ribbon mask does not contact with the corner portion of the paper 41, so that the printing operation can be made without damaging the paper 41.

Hereinafter, the second embodiment according to the invention will be explained. Structured same as the first embodiment is assigned same numeral, so the explanation is omitted. The same operation and effect as the first embodiment are also omitted.

Figure 11:
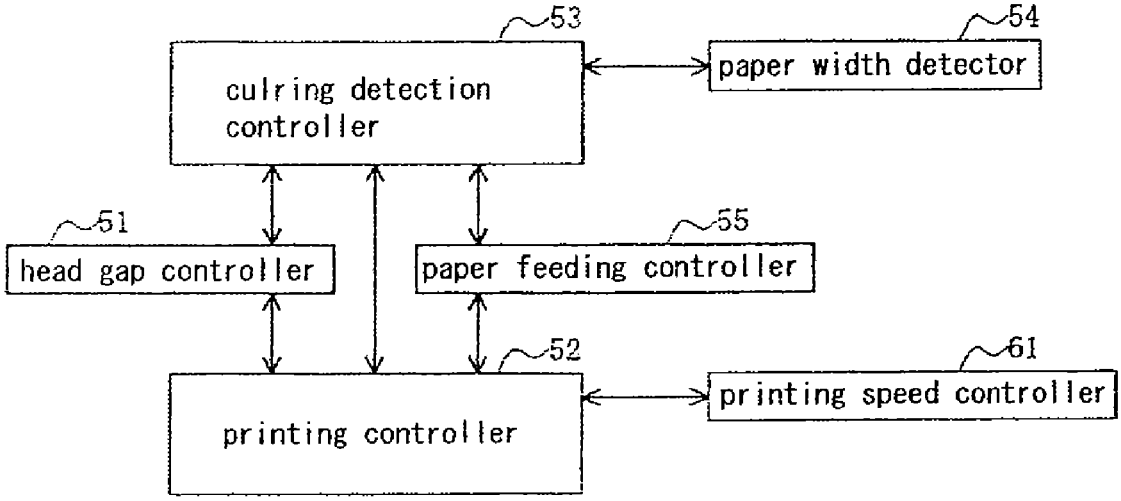
FIG. 11 is a block diagram showing firmware control according to the second embodiment of the invention.

FIG. 11 is a block diagram showing firmware control according to the second embodiment of the invention.

With the printer apparatus according to this embodiment, a printing speed controller 61 for setting a printing speed is newly added to the firmware controller, with respect to the structure of the printer apparatus according to the above first embodiment. The other points regarding the structure are same as the first embodiment, so the duplicate explanation is omitted.

Operation of the printer apparatus according to this embodiment will be explained next. Herein, the operation of the curling detection controller 53 is same as the first embodiment to be omitted explaining while the printing controller 52 will be explained.

Figure 12:
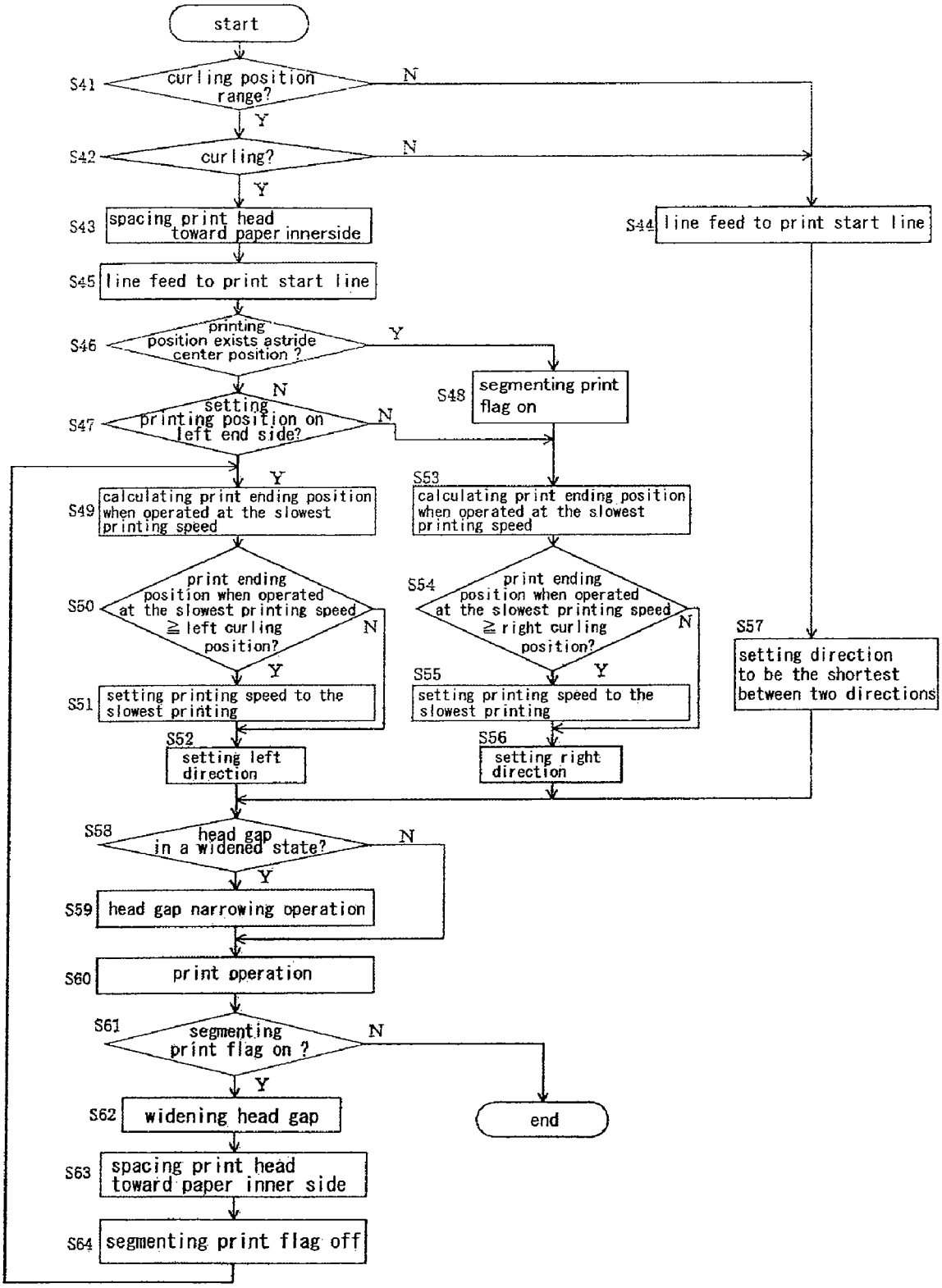
FIG. 12 is a flow chart showing operation of a printing controller according to the second embodiment of the invention.

FIG. 12 is a flow chart showing operation of the printing controller according to the second embodiment of the invention.

Herein, the operation, while the paper 41 is conveyed up to the print start line to operate the line feed, is same as the first embodiment, so the explanation is omitted. The printing direction is subsequently set. The judgment is made first as to whether the printing position exists astride the center portion of the paper 41. Where the printing position does not exist astride the center portion of the paper 41, the judgment is further made as to whether the printing position is situated at the left end side with respect to the center of the paper 41. Where the printing position is situated at the left end side, the operation calculates a print ending position (a print spacing ending position) where the print data are printed at the slowest printing speed of the printer apparatus.

The judgment is then made as to whether the calculated print ending position exceeds the range of the curl at the left end. Herein, the range of the curl at the left end is defined as the arbitrary range from the left end to the inside of the paper 41. Where the print ending position exceeds the range of the curl at the left, the printing speed controller 61 sets the printing speed to the slowest printing speed, and further, the printing direction is set to left (the printing operation in the direction to the curl). Where the print ending position does not exceed the range of the curl at the left end, the printing direction is set to left as unchanged. Where the printing position is not situated at the left end side, the printing speed controller 61 also sets the printing speed to the slowest printing speed, and the printing direction is set to right (the printing operation in the opposite direction with respect to the curl).

As described above, the judgment is made as to whether the printing position exists astride the center portion of the paper 41, and where the printing position exists astride the center portion of the paper 41, the segmenting print flag is turned on, and the print ending position where the print data are printed at the slowest printing speed of the printer apparatus, is calculated.

The judgment is then made as to whether the calculated print ending position exceeds the range of the curl at the right end. Herein, the range of the curl at the right end is defined as the arbitrary range from the right end to the center of the paper 41. Where the print ending position does not exceed the range of the curl at the right, the printing speed controller 61 sets the printing speed to the slowest printing speed, and further, the printing direction is set to right (the printing operation in the direction to the curl). Where the print ending position exceeds the range of the curl at the right end, the printing direction is set to right as unchanged. As described above, the judgment is made as to whether the printing position is situated at the right end side with respect to the center of the paper 41, and where the printing position is not situated at the right end side, the printing direction is set to left (the printing operation in the opposite direction with respect to the curl).

The judgment is subsequently made as to whether the head gap is in the widened state. Where the head gap is in the widened state, the gap motor 24 and the gap sensor 31 operate the print head 21 up to the position suitable for the printing operation, i.e., the narrowing operation of the head gap. The printing operation of the print data is then made. Where the head gap is not in the widened state, the printing of the print data is operated with the head gap in the intact state. The judgment is further made as to whether the segmenting print flag is turned on. Where the segmenting print flag is not turned on, the operation ends, and where the segmenting print flag is turned on, the head gap is made in the widened state, and the spacing operation of the print head 21 is made toward the inner side of the paper 41. The segmenting print flag is then turned off, and the printing direction is set to left, so the subsequent operation returns to a step to make the printing operation. After the operation of the head gap, the printing operation is made from the center portion toward the left end portion of the paper 41. The printing operation is then made over because the segmenting print fag is turned off.

A flow chart will be hereinafter explained. At the step S41, the judgment is made as to whether the position of the print data is situated within the range of the curling position. Where the position of the print data is situated within the range of the curling position, the operation goes to the step S42, and where the position of the print data is situated out of the range of the curling position, the operation goes to the step S44. The judgment is made at the step S42 as to whether the paper 41 is curled. Where the paper 41 is curled, the operation goes to the step S43, and where the paper 41 is not curled, the operation goes to the step S44. At the step 43, the spacing operation of the print head 21 is made up to the center position of the inside of the paper 41. The paper 41 is conveyed up to the print start line to operate the line feed at the step S44. The paper 41 is conveyed up to the print start line, and the line feed is operated at the step S45. At the step S46, the judgment is made as to whether the printing position exists astride the center portion of the paper 41. Where the printing position does not exist astride the center portion of the paper 41, the operation goes to the step S47, and where the printing position exists astride the center portion of the paper 41, the operation goes to the step S48. The judgment is made at the step S47 as to whether the printing position is situated at a left end side. Where the printing position is situated at the left end side, the operation goes to the step S49, and where the printing position is not situated at the left end side, the operation goes to the step S53. The segmenting print flag is turned on at the step S48. At the step S49, the print ending position where the printing operation is made at the slowest printing speed, is calculated. The judgment is made at the step S50 as to whether the print ending position where the printing operation is made at the slowest printing speed, exceeds the curling position at the left end. Where the print ending position where the printing operation is made at the slowest printing speed, exceeds the curling position at the left end, the operation goes to the step S51, and where the print ending position where the printing operation is made at the slowest printing speed, does not exceed the curling position at the left end, the operation goes to the step S52. The printing speed is set to the slowest printing speed at the step S51. At the step S 52, the printing direction is set to left. At the step S53, the print ending position where the printing operation is made at the slowest printing speed, is calculated. The judgment is made at the step S54 as to whether the print ending position where the printing operation is made at the slowest printing speed, exceeds the curling position at the right end. Where the print ending position where the printing operation is made at the slowest printing speed, exceeds the curling position at the right end, the operation goes to the step S56, and where the print ending position where the printing operation is made at the slowest printing speed, does not exceed the curling position at the right end, the operation goes to the step S55. The printing speed is set to the slowest printing speed at the step S55. The printing direction is set to right at the step S56. At the step S57, the printing direction is set to the direction in which the printing operation is made from the end portion of the printing area with the shortest distance to the present position of the print head 21. The judgment is made at the step S58 as to whether the head gap is in the widened state. Where the head gap is in the widened state, the operation goes to the step S59, and where the head gap is not in the widened state, the operation goes to the step S60. The narrowing operation of the head gap is made at the step S61. At the step S62, the printing operation of the print data is made, and this processing ends. The judgment is made at the step S61 as to whether the segmenting print flag is turned on. Where the segmenting print flag is turned on, the operation goes to the step S62, and where the segmenting print flag is not turned on, this processing ends. The widening operation of the head gap is made at the step S62. The spacing operation of the print head 21 is made toward the inner side of the paper 41 at the step S63. At the step S64, the segmenting print flag is turned off, and the operation returns to the step S49.

In this embodiment, like the above, the printing speed controller 61 slows the printing speed to make a distance of the spacing operation for the printing short, thereby being able to prevent the hole of the ribbon mask and the corner portion of the paper 41 from contacting with each other when the print head 21 passes over a curling portion. A furtherance of curling due to the printing operation can be moderated by making the operation at the slow printing speed.

Hereinafter, the third embodiment according to the invention will be explained. Structured same as the first and second embodiments is assigned same numeral, so the explanation is omitted. The same operation and effect as the first and second embodiments are also omitted.

Figure 13:
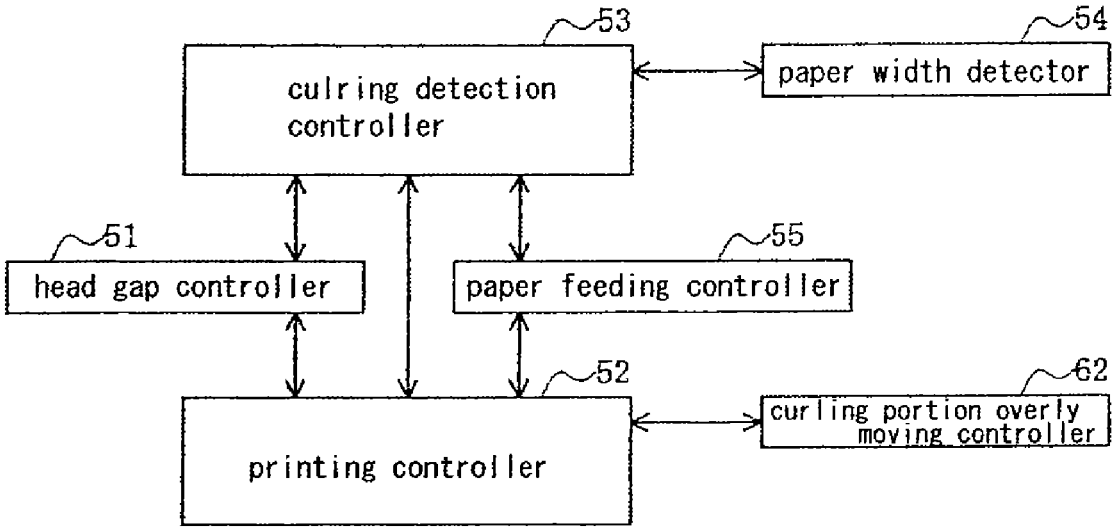
FIG. 13 is a block diagram showing firmware control according to the third embodiment of the invention.

FIG. 13 is a block diagram showing firmware control according to the third embodiment of the invention.

With the printer apparatus according to this embodiment, a curling portion overly moving controller 62 for controlling the printing operation to the position where the print head 21 passes over the curling portion in a case where the printing operation is made within the range of the curling position, is newly added, with respect to the structure of the printer apparatus according to the above first embodiment. The rest points regarding the structure are same as the first embodiment, so the explanation is omitted.

Operation of the printer apparatus according to this embodiment will be explained next. Herein, the operation of the curling detection controller 53 is same as the first embodiment to be omitted explaining while the printing controller 52 will be explained.

Figure 14:
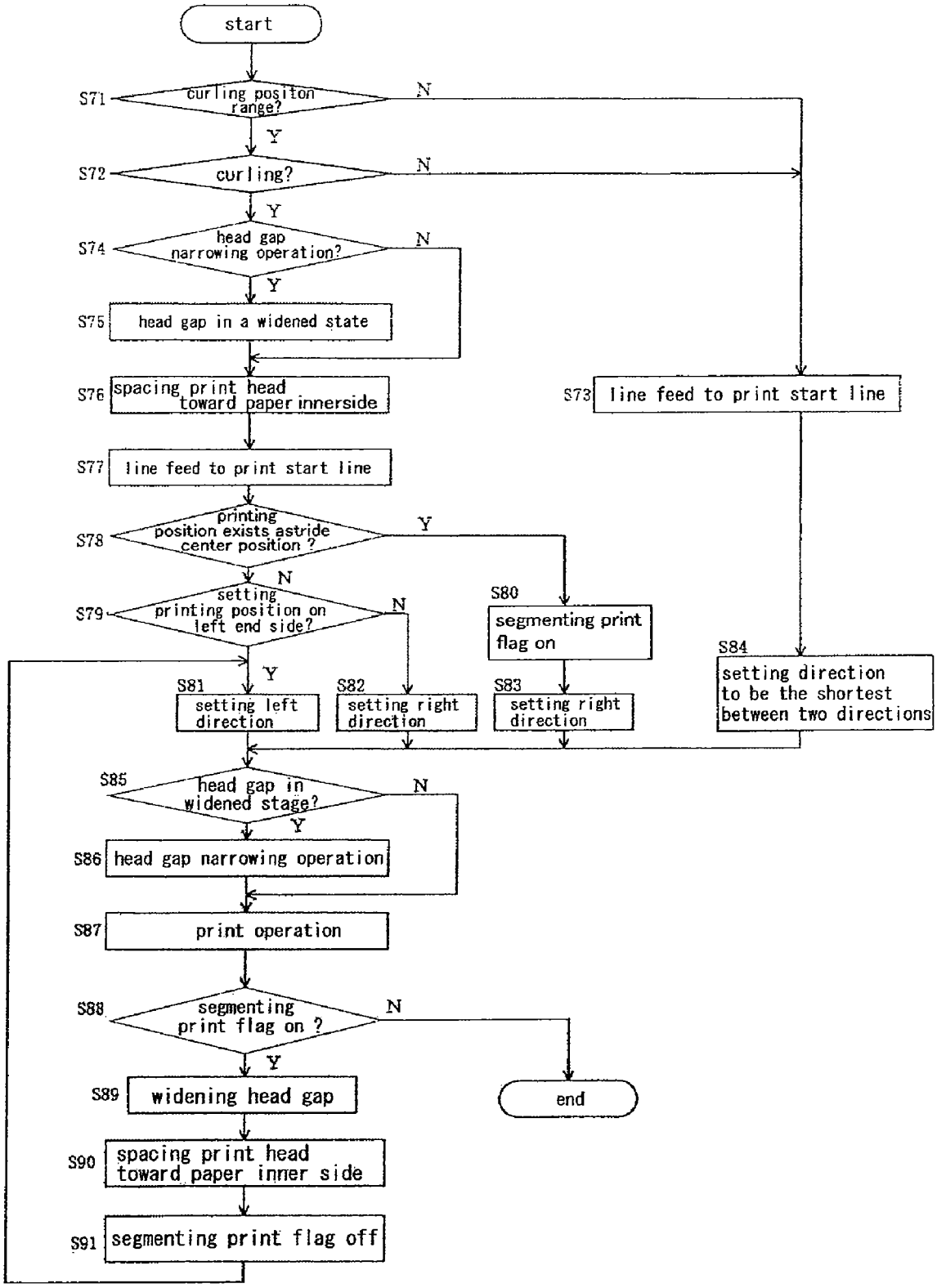
FIG. 14 is a flow chart showing operation of a printing controller according to the third embodiment of the invention.

FIG. 14 is a flow chart showing operation of a printing controller according to the third embodiment of the invention.

When the data receiver 15 receives the print data and the line feed data from the host apparatus, not shown, the main controller 11 operates a data analysis to store the data in the image buffer, before transmits the print request to the mechanism controller 12. The judgment, subsequently, is made as to whether the position of the print data to be printed from now is within the range of the curling position at the upper end of the paper 41. Herein, the range of the curling position is defined as the arbitrary range with respect to the upper end of the paper 41. Where the printing operation is made at the position over the range of the curling position, the paper 41 is conveyed up to the print start line to operate the line feed, and the printing direction is set to the direction in which the printing operation is made from the end portion of the printing area with the shortest distance to the present position of the print head 21.

Where the printing operation is made within the range of the curling position, according to the paper curling status information set by the curling detection controller 53, the judgment is made as to whether the paper 41 is curled. Where the paper 41 is not curled, the paper 41 is conveyed up to the print start line to operate the line feed, and the printing direction is set to the direction in which the printing operation is made from the end portion of the printing area with the shortest distance to the present position of the print head 21. Where the paper 41 is curled, the judgment is made as to whether the head gap is in a narrowed state. Where the head gap is in the narrowed state, the head gap is made in the widened state, and the paper width detector 54 operates the space motor 22 to make spacing operation of the print head 21 up to the center position of an inside of the paper 41. Where the head gap is not in the narrowed state, the spacing operation is operated with the head gap in the intact state. The paper 41 is then conveyed up to the print start line to operate the line feed. It is to be noted that the subsequent operation is same as the first embodiment, so the explanation is omitted.

A flow chart will be hereinafter explained. At the step S71, the judgment is made as to whether the position of the print data is situated within the range of the curling position. Where the position of the print data is situated within the range of the curling position, the operation goes to the step S72, and where the position of the print data is situated out of the range of the curling position, the operation goes to the step S73. The judgment is made at the step S72 as to whether the paper 41 is curled. Where the paper 41 is curled, the operation goes to the step S74, and where the paper 41 is not curled, the operation goes to the step S73. The paper 41 is conveyed up to the print start line to operate the line feed at the step S73. The judgment is made at the step S74 as to whether the head gap is in the narrowed state. Where the head gap is in the narrowed state, the operation goes to the step S75, and where the head gap is not in the narrowed state, the operation goes to the step S76. The widening operation of the head gap is made at the step S75. At the step 76, the spacing operation of the print head 21 is made up to the center position of the inside of the paper 41. The paper 41 is conveyed up to the print start line to operate the line feed at the step S77. The judgment is made at the step S78 as to whether the printing position exists astride the center portion of the paper 41. Where the printing position does not exist astride the center portion of the paper 41, the operation goes to the step S79, and where the printing position exists astride the center portion of the paper 41, the operation goes to the step S80. The judgment is made at the step S79 as to whether the printing position is situated at a left end side. Where the printing position is situated at the left end side, the operation goes to the step S81, and where the printing position is not situated at the left end side, the operation goes to the step S82. The printing direction is set to left at the step S81. The printing direction is set to right at the step S82. The segmenting print flag is turned on at the step S80. The printing direction is set to right at the step S83. At the step S84, the printing direction is set to the direction in which the printing operation is made from the end portion of the printing area with the shortest distance to the present position of the print head 21. The judgment is made at the step S85 as to whether the head gap is in the widened state. Where the head gap is in the widened state, the operation goes to the step S86, and where the head gap is not in the widened state, the operation goes to the step S87. The narrowing operation of the head gap is made at the step S86. At the step S87, the printing operation of the print data is made. The judgment is made at the step S88 as to whether the segmenting print flag is turned on. Where the segmenting print flag is turned on, the operation goes to the step S89, and where the segmenting print flag is not turned on, this processing ends. The widening operation of the head gap is made at the step S89. The spacing operation of the print head 21 is made toward the inner side of the paper 41 at the step S90. At the step S39, the segmenting print flag is turned off, and the operation returns to the step S81.

In this embodiment, like the above, where the printing operation is made within the range of the curling position, the print head 21 is spaced toward the inside of the paper 41 after making the head gap in the widened state, and the head gap is then made in the narrowed state when printing the print data. Therefore, the curling position and the print head 21 are prevented from contacting with each other. More specifically, when the head spacing operation is made from the outer side to the center of the paper 41, within the range of the curling position, the printing is controlled by the curling portion overly moving controller 62 to operate after the print head 21 passes over the curling portion.

Hereinafter, the forth embodiment according to the invention will be explained. Structured same as the first, second, and third embodiments is assigned same numeral, so the explanation is omitted. The same operation and effect as the first, second, and third embodiments are also omitted.

Figure 15:
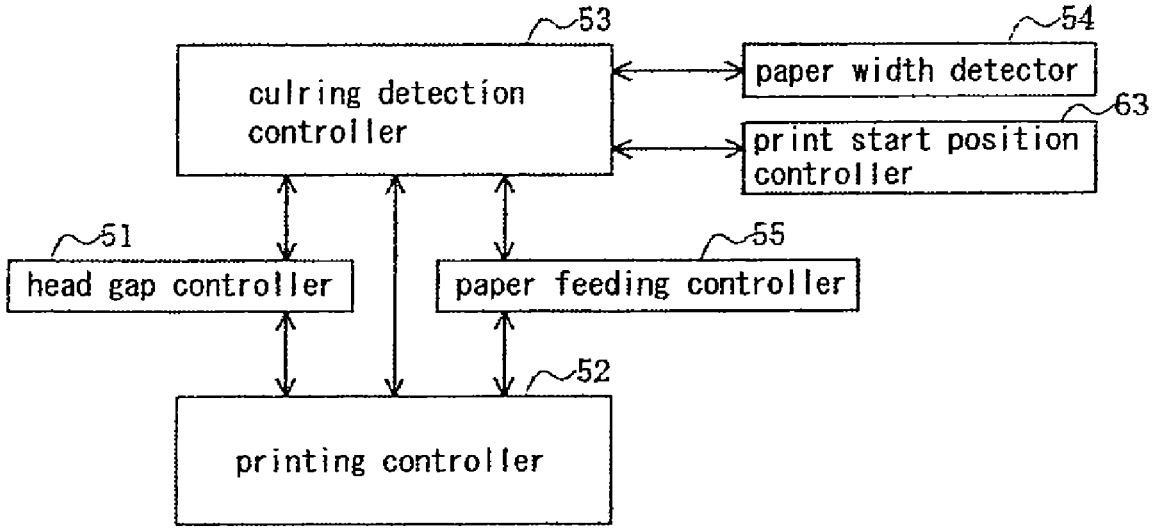
FIG. 15 is a block diagram showing firmware control according to the fourth embodiment of the invention.

FIG. 15 is a block diagram showing firmware control according to the fourth embodiment of the invention.

With the printer apparatus according to this embodiment, a print start position controller 63 for setting the print start position is newly added, with respect to the structure of the printer apparatus according to the above first embodiment. The rest points regarding the structure are same as the first embodiment, so the explanation is omitted.

Operation of the printer apparatus according to this embodiment will be explained next. Herein, the operation of the printing controller 52 is same as the first embodiment to be omitted explaining while the curling detection controller 53 will be explained.

Figure 16:
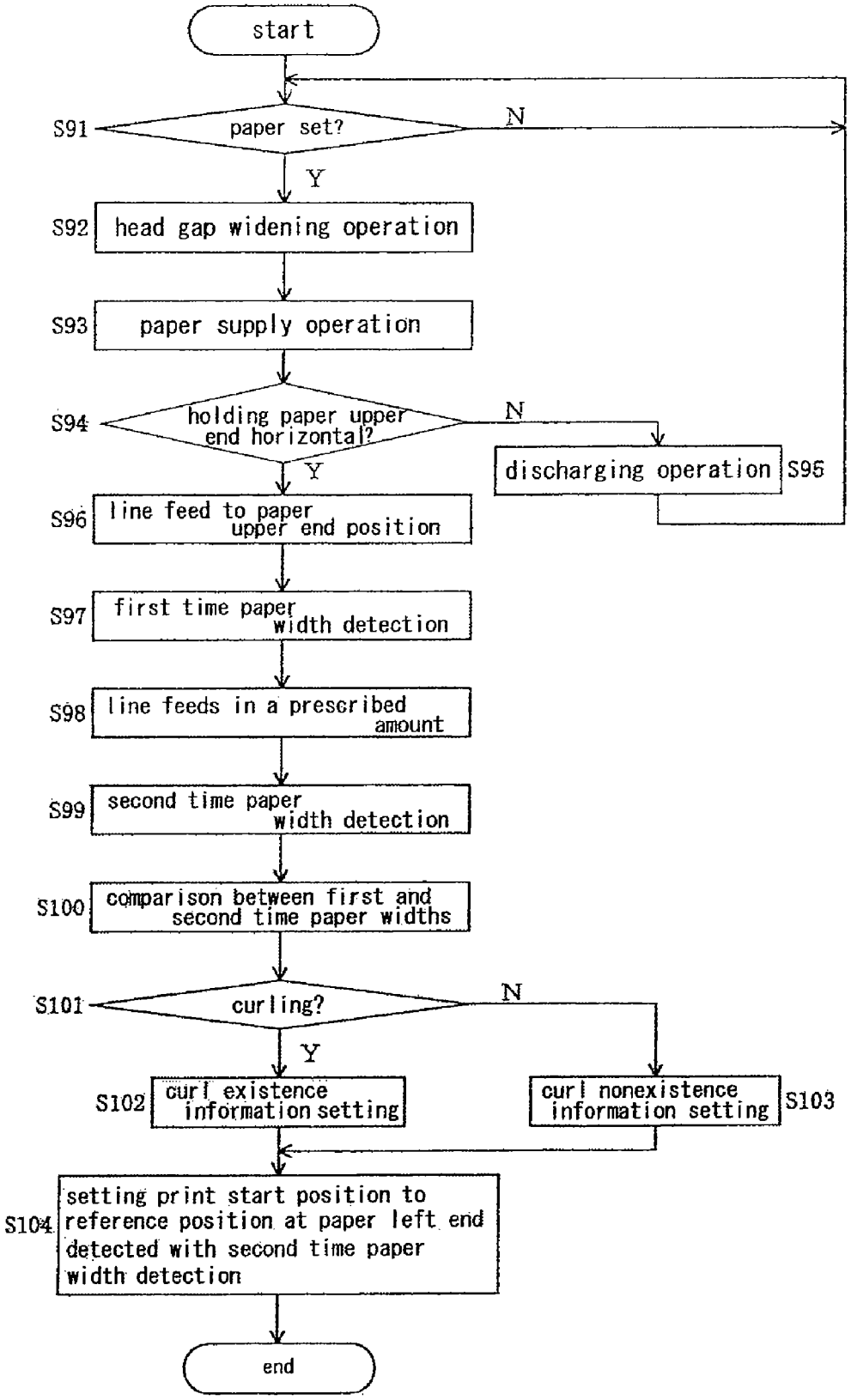
FIG. 16 is a flow chart showing operation of a curling detection controller according to the fourth embodiment of the invention.

FIG. 16 is a flow chart showing operation of a curling detection controller according to the fourth embodiment of the invention.

Herein, during the period from making judgment as to whether the paper 41 is curled to setting the states of curling existence at either the left of right end of the paper 41 or to setting in the paper curling status information the status the states of curling nonexistence, the operation is same as the first embodiment, so the explanation is omitted.

The paper curling status information is subsequently set, the print start position controller 63 sets the print start position. In this case, the left end position L2 detected already during the paper width detection operation at the second time, is defined as the reference position zero. More specifically, the position including unprintable area from the paper left end to the print start position, set as a margin amount by the user in set-up mode or the like, is set as the print start position. For example, where the left end position of the paper 41 is 20 [mm] away from the leftmost position of the range of the spacing operation while a margin amount is 5.1 [mm], the print start position is set 2.51 [mm] away from the leftmost position of the range of the spacing operation. More specifically, the print start position is set at the position 5.1 [mm] away from the left end position L2 as the reference position zero. When the print start position is set, the printing controller 52 makes the printing operation from the above described print start position.

Hereinafter, a flow chart will be explained. At the step S91, the judgment is made as to whether the paper 41 is set on the table sensor 34. Where the paper 41 is set on the table sensor 34, the operation goes to the step S92, and where the paper 41 is not set on the table sensor 34, the operation stays standby state. The widening operation of the head gap is done at the step S92. The paper supply operation is done at the step S93. At the step S94, the judgment is made as to whether the upper end of the paper 41 is horizontally supplied. Where the upper end of the paper 41 is horizontally supplied, the operation goes to the step S96, and where the paper 41 is not horizontally supplied, the operation goes to the step S95. The discharging operation is done at the step S95. The feed line is operated up to the upper end position of the paper 41 at the step S96. The paper width detection operation at the first time is operated at the step S97. The line feeds in the prescribed amount are operated at the step S98. The paper width detection operation at the second time is operated at the step S99.

The paper widths at the first and second times respectively are compared at the step S100. At the step S101, the judgment is made as to whether either the left end or the right end of the paper 41 is curled. Where either the left end or the right end of the paper 41 is curled, the operation goes to the step S102, and where neither the left end nor the right end of the paper 41 is curled, the operation goes to the step S103. The status that the paper 41 is curled is set at the step S102. The status that the paper 41 is not curled is set at the step S103. At the step S104, the print start position is set with respect to the left end position L2 of the paper 41 as the reference position zero, detected during the paper width detection operation at the second time, and this processing is then made over.

In this embodiment, like the above, the print start position is set by the print start position controller 63 with respect to the reference position zero identical to the left end position L2 of the paper 41 detected at the position where the paper 41 is conveyed as much as the predetermined distance from the upper end position thereof during the paper supply. Therefore, even where the curled paper 41 is used, the wrong detection of the left end position can be eliminated, so that the misaligned print format during the printing operation can be prevented Hereinafter, the fifth embodiment according to the invention will be explained. Structured same as those in the first to fourth embodiments are assigned same numeral, so the duplicated explanation is omitted. The same operation and effect as from the first to fourth embodiments are also omitted.

Figure 17:
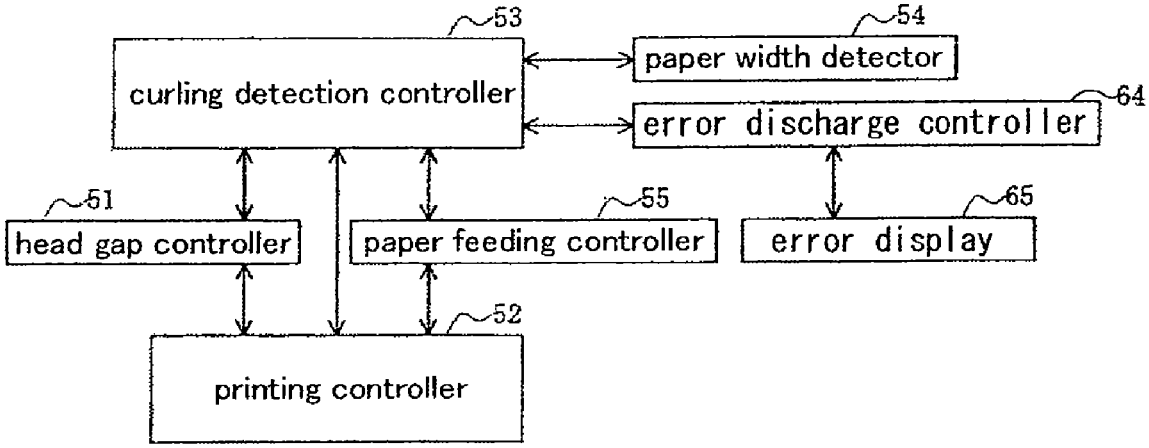
FIG. 17 is a block diagram showing firmware control according to the fifth embodiment of the invention.

FIG. 17 is a block diagram showing firmware control according to the fifth embodiment of the invention.

With the printer apparatus according to this embodiment, an error discharge controller 64 and an error display portion 65 are newly added, with respect to the structure of the printer apparatus according to the above first embodiment. The error discharge controller 64 controls to discharge the paper 41 when the curling detection controller 53 detects the paper 41 with the curling amount such that the paper 41 cannot be conveyed while the error display portion 65 displays to inform the user the status that the paper 41 with the curling amount such that the paper 41 cannot be conveyed is discharge. The rest points regarding the structure are same as the first embodiment, so the explanation is omitted.

Operation of the printer apparatus according to this embodiment will be explained next. Herein, the operation of the printing controller 52 is same as the first embodiment to be omitted explaining while the curling detection controller 53 will be explained.

Figure 18:
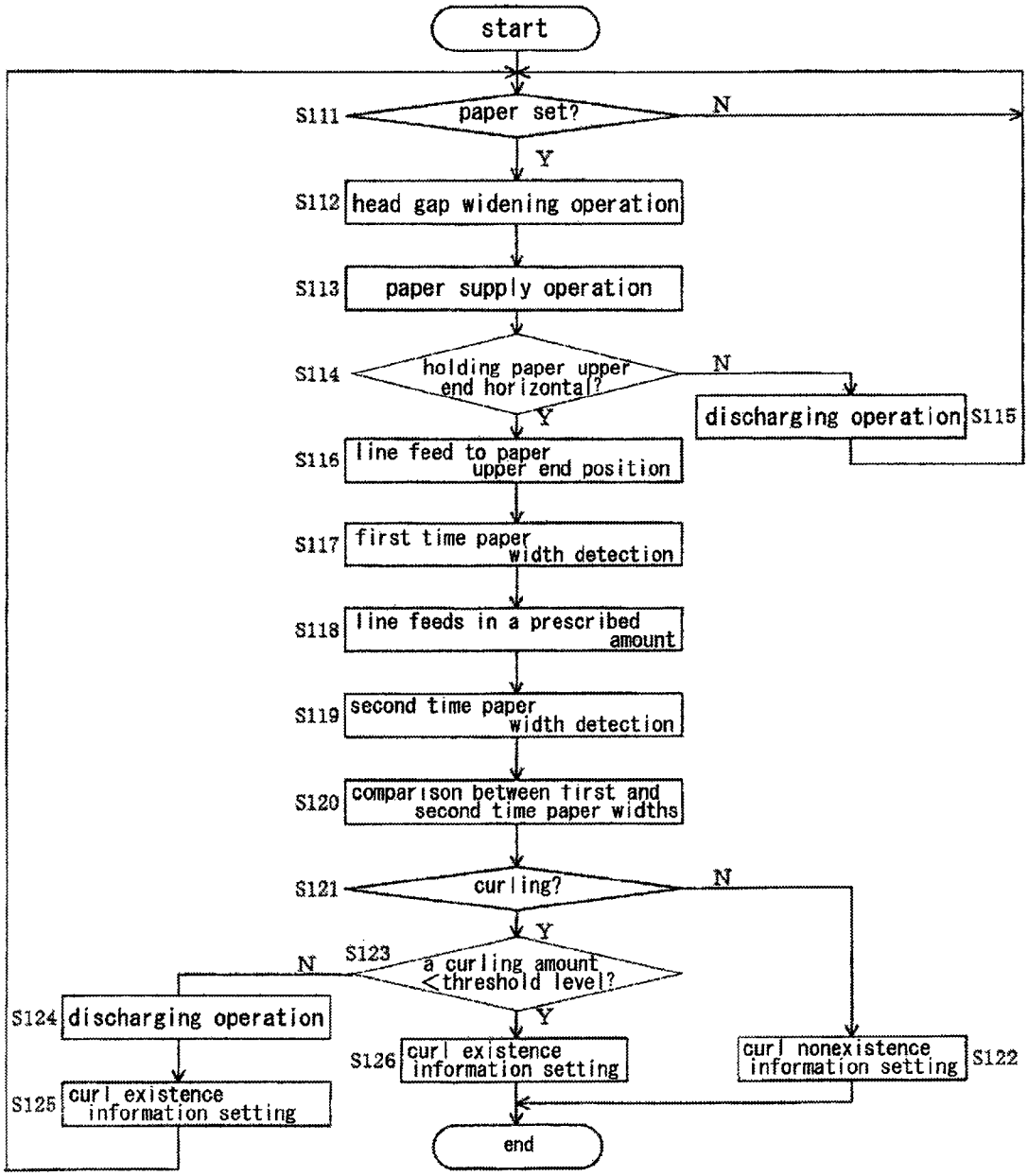
FIG. 18 is a flow chart showing operation of a curling detection controller according to the fifth embodiment of the invention.

FIG. 18 is a flow chart showing operation of a curling detection controller according to the fifth embodiment of the invention.

Herein, the operation until making the judgment as to the paper 41 is curled, is same as the first embodiment, so the explanation is omitted.

By comparing each of the left and right end positions of the paper 41 detected at the first and second time respectively with the paper width detector 54, the curling detection controller 53 judges as to whether the paper 41 is curled. More specifically, the curling detection controller 53 judges a curling status in comparing the left end position at the first time L1 and the right end position at the first time R1 with the left end position at the second time L2 and the right end position at the second time R2. As shown FIG. 8, the leftmost position of a head spacing operation range is defined as a reference position zero. Herein, where the foregoing Expression (1) is satisfied, the left end of the paper 41 is judged as curled, and the curling amount is calculated by the foregoing Expression (2). Furthermore, where the foregoing Expression (3) is satisfied, the left end of the paper 41 is judged as not curled.

Where the foregoing Expression (4) is satisfied, the right end of the paper 41 is judged as curled, and the curling amount is calculated by the foregoing Expression (5). Furthermore, where the foregoing Expression (6) is satisfied, the right end of the paper 41 is judged as not curled.

Where neither the left end nor the right end of the paper 41 is curled, the status of curl nonexistence is set in paper curling status information, and this processing ends. Where both the left and right ends of the paper 41 are curled, the curling amounts at the right and the left ends are compared in size, and the position with the larger curling amount is compared with a threshold level to make the judgment as to whether the curling amount is less than the threshold level. In that event, the threshold level, which is able to be preliminarily gotten by an experiment, is defined as the curling amount possibly causing an obstruction such a paper jam, the folding of the paper, or the like when the curled paper 41 passes over the paper guide on the downstream side with respect to the printing position. Where the curling amount less than the threshold level is such that the normal paper conveyance is performable, the status that either the left or right end of the paper 41 is curled is set, and this processing ends. Where the curling amount more than the threshold is such that paper conveyance is not performable, the error discharge controller 64 makes the discharging operation of the paper 41, so that the error display portion 65 makes the LCD 49 display to inform the user, as an error message, the status that the paper 41 with the curling amount unable to make the paper conveyance is discharged. In this situation, in a case, e.g., where the LCD 49 is a LCD enable to display sixteen figures of the Japanese alphabets, Kana, within a double column, the error messages, e.g., Japanese message meaning of "curled paper was discharged" and Japanese message meaning of "please confirm paper" are displayed in an upper column and a lower column of the LCD 49 respectively, and then the operation stays standby state until the new paper is set.

Hereinafter, a flow chart will be explained. At the step S111, the judgment is made as to whether the paper 41 is set on the table sensor 34. Where the paper 41 is set on the table sensor 34, the operation goes to the step S112, and where the paper 41 is not set on the table sensor 34, the operation stays standby state. The widening operation of the head gap is done at the step S112. The paper supply operation is done at the step S113. At the step S114, the judgment is made as to whether the upper end of the paper 41 is horizontally supplied. Where the upper end of the paper 41 is horizontally supplied, the operation goes to the step S116, and where the paper 41 is not horizontally supplied, the operation goes to the step S115. The discharging operation is done at the step S115. The feed line is operated up to the upper end position of the paper 41 at the step S116. The paper width detection operation at the first time is operated at the step S117. The line feeds in the prescribed amount are operated at the step S118. The paper width detection operation at the second time is operated at the step S19. The paper widths at the first and second times respectively are compared at the step S120. At the step S121, the judgment is made as to whether either the left end or the right end of the paper 41 is curled. Where either the left end or the right end of the paper 41 is curled, the operation goes to the step S123, and where neither the left end nor the right end of the paper 41 is curled, the operation goes to the step S122. At the step S122, the status that the paper 41 is not curled is set, and this processing ends. At the step S123, a comparison of the curling amount with the threshold level is performed, and where the curling amount is less than the threshold level, the operation goes to the step S126 while where the curling amount is more than the threshold level, the operation goes to the step S124. The discharging operation is done at the step S124. At the step S125, the error display portion 65 displays on the LCD 49 the warning meaning that the curled paper as the error medium is already discharged. At the step S126, the status that the paper 41 is curled is set, and this processing ends.

In this embodiment, like the above, as well as the damages of the paper and the ribbon mask occurred during the printing operation, the paper travel jam occurred when the upper end of the paper 41 passes over the paper guide on the downstream with respect to the printing position can be preliminarily prevented. Prevention of delay in the printing operation due to the wrong printing to the paper 41 having the already completely folded corner portion, can also be intended.

Hereinafter, the sixth embodiment according to the invention will be explained. Structured same as from the first to fifth embodiments is assigned same numeral, so the explanation is omitted. The same operation and effect as from the first to fifth embodiments are also omitted.

Figure 19:
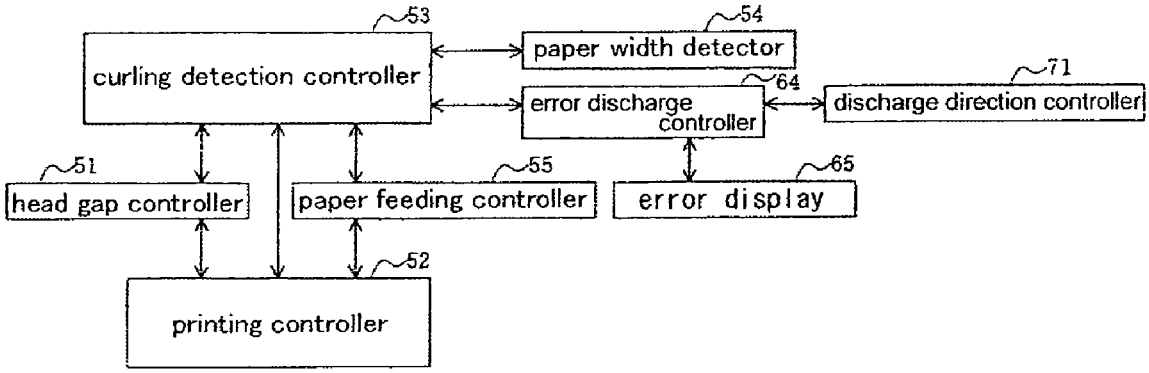
FIG. 19 is a block diagram showing firmware control according to the sixth embodiment of the invention.

FIG. 19 is a block diagram showing firmware control according to the sixth embodiment of the invention.

With the printer apparatus according to this embodiment, a discharge direction controller 71 for setting a discharge direction is newly added, with respect to the structure of the printer apparatus according to the above first embodiment. The rest points regarding the structure are same as the first embodiment, so the explanation is omitted.

Operation of the printer apparatus according to this embodiment will be explained next. Herein, the operation of the printing controller 52 is same as the first embodiment to be omitted explaining while the curling detection controller 53 will be explained.

Figure 20:
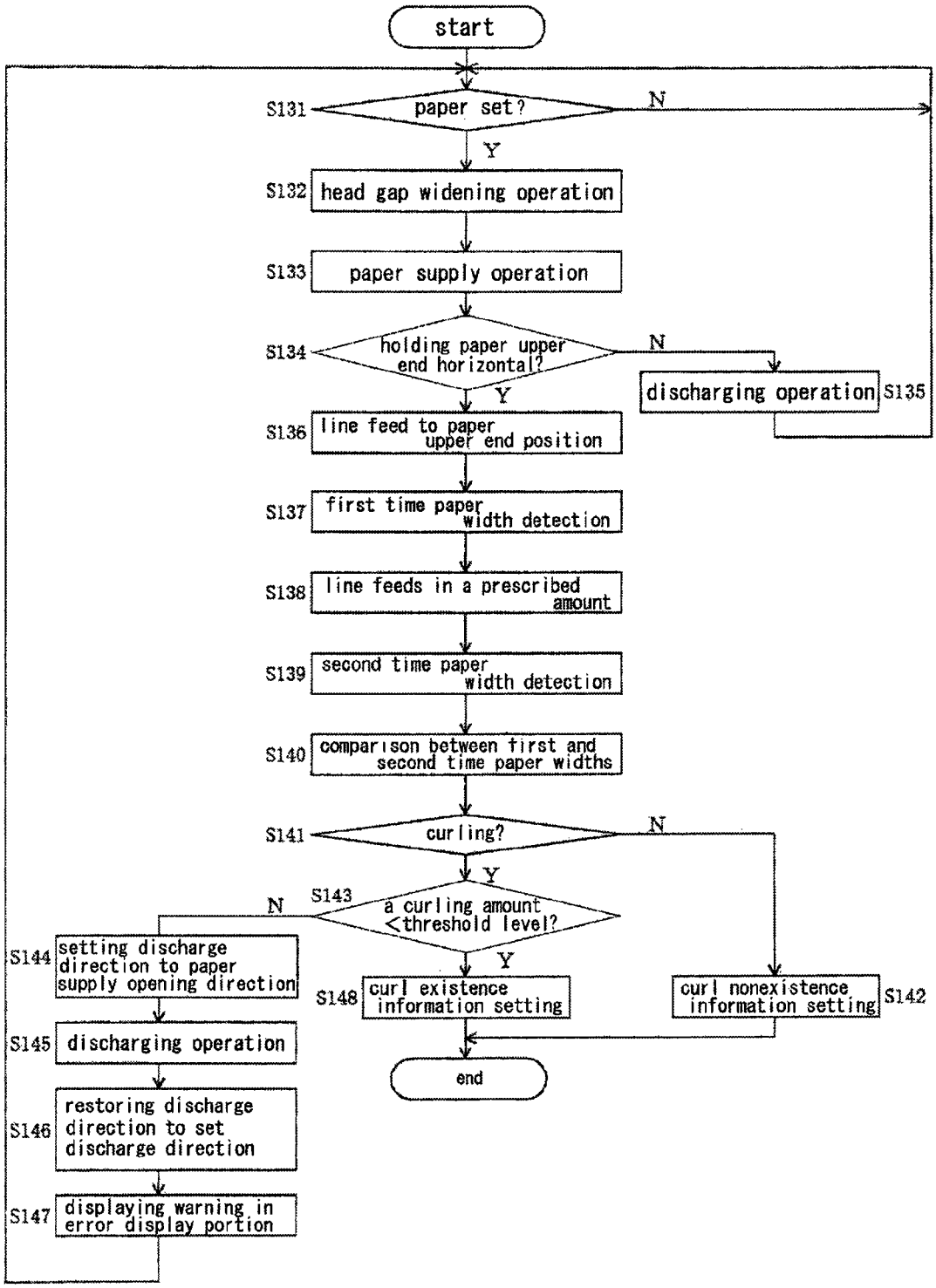
FIG. 20 is a flow chart showing operation of a curling detection controller according to the sixth embodiment of the invention.

FIG. 20 is a flow chart showing operation of a curling detection controller according to the sixth embodiment of the invention.

Herein, the operation until the judgment is made as to the paper 41 is curled is same as the first embodiment, so the explanation is omitted.

By comparing each of the left and right end positions of the paper 41 detected at the first and second time respectively with the paper width detector 54, the curling detection controller 53 judges as to whether the paper 41 is curled. More specifically, the curling detection controller 53 judges a curling status in comparing the left end position at the first time L1 with the second left end position at the second time L2 and the right end position at the first time R1 and the second right end position at the second time R2. As shown FIG. 8, the leftmost position of a head spacing operation range is defined as a reference position zero. Herein, where the foregoing Expression (1) is satisfied, the left end of the paper 41 is judged as curled, and the curling amount is calculated by the foregoing Expression (2). Furthermore, where the foregoing Expression (3) is satisfied, the left end of the paper 41 is judged as not curled.

Where the foregoing Expression (4) is satisfied, the right end of the paper 41 is judged as curled, and the curling amount is calculated by the foregoing Expression (5). Furthermore, where the foregoing Expression (6) is satisfied, the right end of the paper 41 is judged as not curled.

Where neither the left end nor the right end of the paper 41 is curled, the status of curl nonexistence is set in paper curling status information, and this processing ends. Where both the left and right ends of the paper 41 are curled, the curling amounts at the right and the left ends are compared in size, and the position with the larger curling amount is compared with a threshold level to make the judgment as to whether the curling amount is less than the threshold level. Where the curling amount less than the threshold level is such that the normal paper conveyance is performable, the status that either the left or right end of the paper 41 is curled is set, and this processing ends. Where the curling amount more than the threshold is such that paper conveyance is not performable, the discharge direction controller 71 sets the discharge direction to the direction to the paper supply opening at the front side.

The error discharge controller 64 operates the discharging operation of the paper 41, and the discharge direction is restored to the direction to either the paper supply opening at the front side or the discharge opening at the back side, as the direction already set in the set-up mode or with a switch control. The error display portion 65 makes the LCD 49 display to inform the user, as an error message, the status that the paper 41 with the curling amount unable to make the paper conveyance is discharged. The operation subsequently displays the error message and then stays standby state until the new paper is set.

Hereinafter, a flow chart will be explained. At the step S131, the judgment is made as to whether the paper 41 is set on the table sensor 34. Where the paper 41 is set on the table sensor 34, the operation goes to the step S132, and where the paper 41 is not set on the table sensor 34, the operation stays standby state. The widening operation of the head gap is done at the step S132. The paper supply operation is done at the step S133. At the step S134, the judgment is made as to whether the upper end of the paper 41 is horizontally supplied. Where the upper end of the paper 41 is horizontally supplied, the operation goes to the step S136, and where the paper 41 is not horizontally supplied, the operation goes to the step S135. The discharging operation is done at the step S135. The feed line is operated up to the upper end position of the paper 41 at the step S136. The paper width detection operation at the first time is operated at the step S137. The line feeds in the prescribed amount are operated at the step S138. The paper width detection operation at the second time is operated at the step S139. The paper widths at the first and second times respectively are compared at the step S140. At the step S141, the judgment is made as to whether either the left end or the right end of the paper 41 is curled. Where either the left end or the right end of the paper 41 is curled, the operation goes to the step S143, and where neither the left end nor the right end of the paper 41 is curled, the operation goes to the step S142. At the step S142, the status that the paper 41 is not curled is set, and this processing ends. At the step S143, a comparison of the curling amount with the threshold level is performed, and where the curling amount is less than the threshold level, the operation goes to the step S148 while where the curling amount is more than the threshold level, the operation goes to the step S144. At the step S144, the discharge direction is set to the paper supply opening. The discharging operation is done at the step S145. At the step S146, the discharge direction is set to the already set direction. At the step S147, the error display portion 65 displays on the LCD 49 the warning meaning that the curled paper as the error medium is already discharged. At the step S148, the status that the paper 41 is curled is set, and this processing ends.

In this embodiment, like the above, where the printer apparatus has such a structure that the discharge direction of the paper 41 can be set to the direction to either the paper supply opening at the front side or the discharge opening at the back side, the discharge direction controller 71 secures the discharge direction toward the paper supply opening at the front side when the curled paper is discharged. Therefore, the paper 41 can be prevented from occurring the paper travel jam, damaging of the paper, or the like when passing over the paper guide or a field roller.

Hereinafter, the seventh embodiment according to the invention will be explained. Structured same as from the first to sixth embodiments is assigned same numeral, so the explanation is omitted. The same operation and effect as from the first to sixth embodiments are also omitted.

Figure 21:
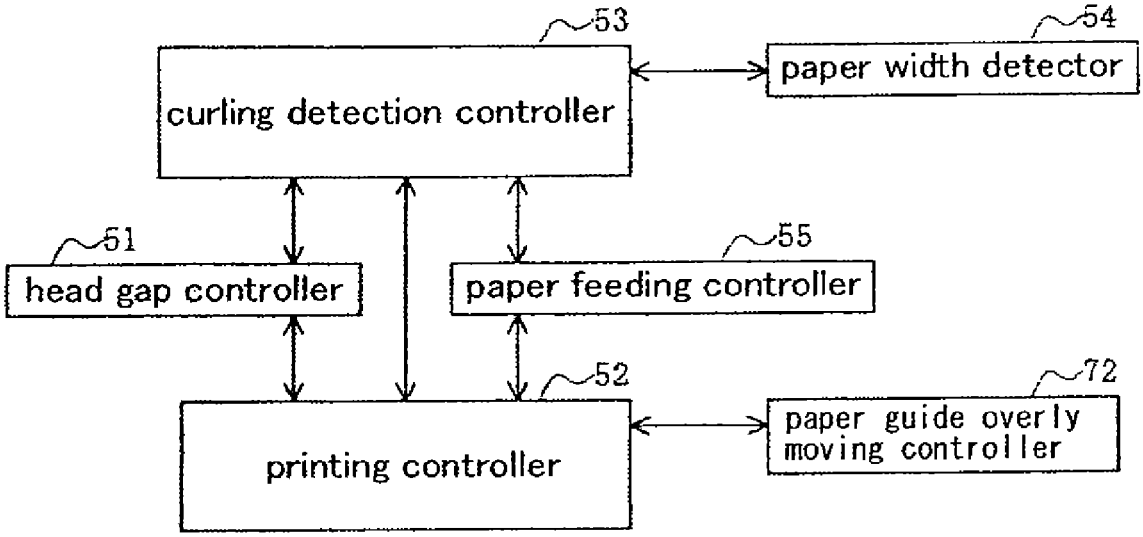
FIG. 21 is a block diagram showing firmware control according to the seventh embodiment of the invention.

FIG. 21 is a block diagram showing firmware control according to the seventh embodiment of the invention.

With the printer apparatus according to this embodiment, a paper guide overly moving controller 72 for judging and controlling as to whether the upper end position of the paper 41 passes over the paper guide is newly added, with respect to the structure of the printer apparatus according to the above first embodiment. The rest points regarding the structure are same as the first embodiment, so the explanation is omitted.

Operation of the printer apparatus according to this embodiment will be explained next. Herein, the operation of the curling detection controller 53 is same as the first embodiment to be omitted explaining while the printing controller 52 will be explained.

Figure 22:
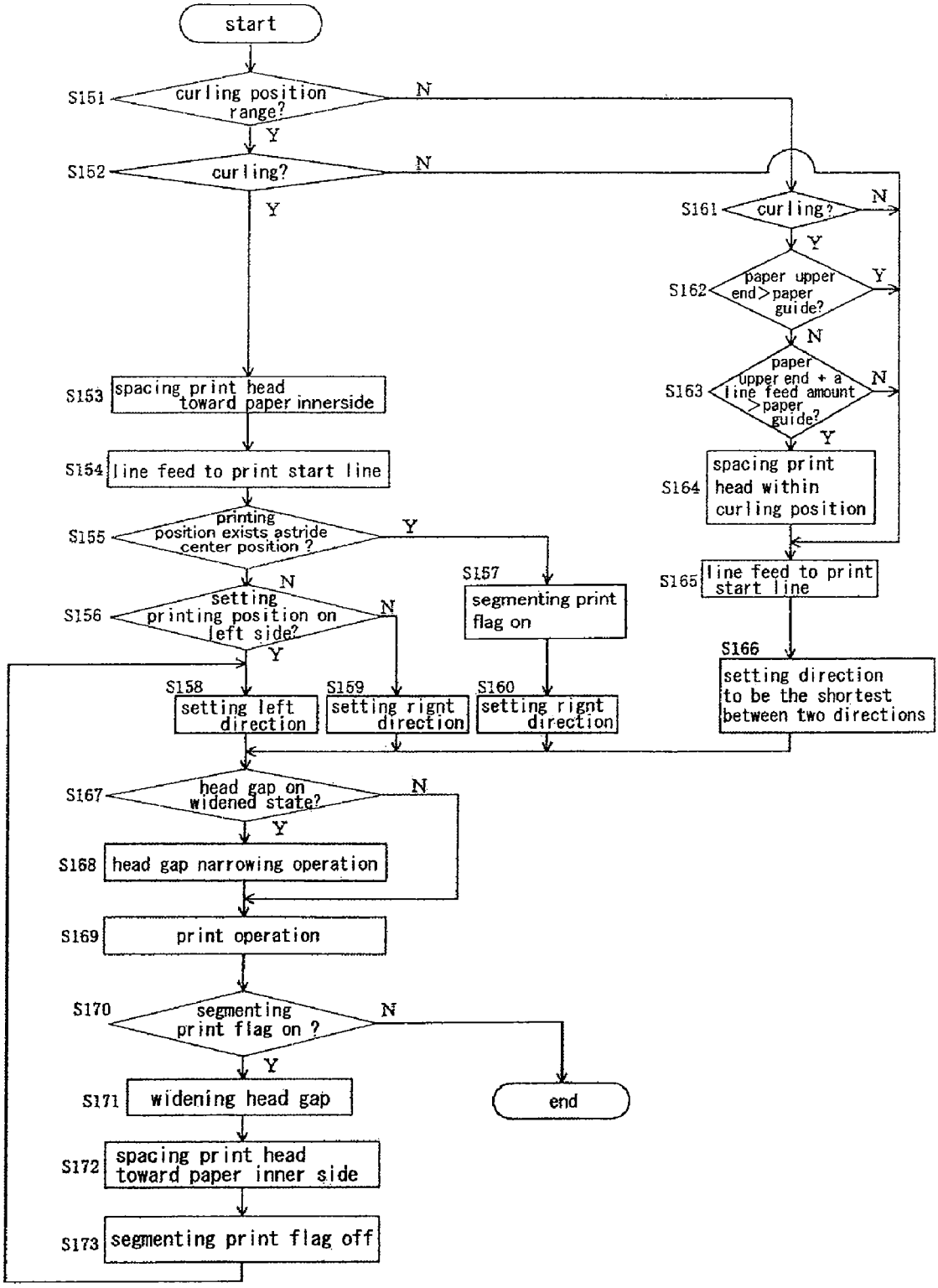
FIG. 22 is a flow chart showing operation of a printing controller according to the seventh embodiment of the invention.

FIG. 22 is a flow chart showing operation of a printing controller according to the seventh embodiment of the invention.

When the data receiver 15 receives the print data and the line feed data from the host apparatus, not shown, the main controller 11 operates a data analysis to store the data in the image buffer, before transmits the print request to the mechanism controller 12. The judgment, subsequently, is made as to whether the position of the print data to be printed from now is within the range of the curling position at the upper end of the paper 41. Herein, the range of the curling position is defined as the arbitrary range with respect to the upper end of the paper 41. Where the printing operation is made at the position over the range of the curling position, the judgment is made as to whether the paper 41 is curled.

Where the paper 41 is not curled, the paper 41 is conveyed up to the print start line to operate the line feed, and the printing direction is set to the direction in which the printing operation is made from the end portion of the printing area with the shortest distance to the present position of the print head 21. Where the paper 41 is curled, the judgment is made with the paper guide overly moving controller 72 as to whether the present upper end position of the paper 41 passes over the paper guide on the downstream with respect to the printing position. Where the upper end of paper 41 already passes over the paper guide on the downstream, the normal line feed is operated. Where the upper of the paper 41 does not passes over and remains in the front of the paper guide on downstream, the judgment is made as to whether the upper end of the paper 41 passes over the paper guide after the line feed is operated. Where the upper end of the paper 41 does not pass over the paper guide even after the line feed is operated, the normal line feed is operated. Where the upper end of the paper 41 passes over the paper guide after the line feed is operated, spacing operation of the print head 21 is operated onto the curling position. Herein, where the left end position of the paper 41 is curled, the operation amount is calculated by following Expression (7).

$$\text{The operation amount} = \text{the left end position of the paper} - \text{the present position of the print head 21} \quad \text{Expression (7)}$$

The paper 41 is subsequently conveyed up to the print start line to operate the line feed, and the printing direction is set to the direction in which the printing operation is made from the end portion of the printing area with the shortest distance to the present position of the print head 21.

As described above, the judgment is made as to whether the position of the print data is situated within the range of the curling position at the upper end of the paper 41, and where the printing operation is made within the range of the curling position, according to the paper curling status information set by the curling detection controller 53, the judgment is made as to whether the paper 41 is curled. Where the paper 41 is not curled, the paper 41 is conveyed up to the print start line to operate the line feed, and the printing direction is set to the direction in which the printing operation is made from the end portion of the printing area with the shortest distance to the present position of the print head 21. Where the paper 41 is curled, the paper width detector 54 operates the space motor 22 to make a spacing operation of the print head 21 up to the center position of an inside of the paper 41. The paper 41 is then conveyed up to the print start line to operate the line feed. It is to be noted that the subsequent operation is same as the first embodiment, so the explanation is omitted.

A flow chart will be hereinafter explained. At the step S151, the judgment is made as to whether the position of the print data is situated within the range of the curling position. Where the position of the print data is situated within the range of the curling position, the operation goes to the step S152, and where the position of the print data is situated out of the range of the curling position, the operation goes to the step S162. The judgment is made at the step S152 as to whether the paper 41 is curled. Where the paper 41 is curled, the operation goes to the step S153, and where the paper 41 is not curled, the operation goes to the step S166. At the step 153, the spacing operation of the print head 21 is made up to the center position of the inside of the paper 41. The paper 41 is conveyed up to the print start line to operate the line feed at the step S154.

The judgment is made at the step S155 as to whether the printing position exists astride the center portion of the paper 41. Where the printing position does not exist astride the center portion of the paper 41, the operation goes to the step S156, and where the printing position exists astride the center portion of the paper 41, the operation goes to the step S157. The judgment is made at the step S156 as to whether the printing position is situated at the left end side. Where the printing position is situated at the left end side, the operation goes to the step S158, and where the printing position is not situated at the left end side, the operation goes to the step S159. The printing direction is set to left at the step S158. The printing direction is set to right at the step S159. The printing direction is set to right at the step S160. The judgment is made at the step S161 as to whether the paper 41 is curled. Where the paper 41 is curled, the operation goes to the step S1162, and where the paper 41 is not curled, the operation goes to the step S165. At the step S162, the judgment is made as to whether the upper end of the paper 41 passes over the paper guide on the downstream with respect to the printing position. Where the upper end of the paper 41 passes over the paper guide on the downstream with respect to the printing position, the operation goes to the step S165, and where the upper end of the paper 41 does not pass over the paper guide on the downstream with respect to the printing position, the operation goes to the step S163. The judgment is made at the step S163 as to whether the position including the upper end of the paper 41 plus the line feed amount, passes over the paper guide on the downstream with respect to the printing position. Where the position including the upper end of the paper 41 plus the line feed amount, passes over the paper guide on the downstream with respect to the printing position, the operation goes to the step S164. Where the position including the upper end of the paper 41 plus the line feed amount, does not pass over the paper guide on the downstream with respect to the printing position, the operation goes to the step S165. At the step 164, the spacing operation of the print head 21 is made up to the curling position. The paper 41 is conveyed up to the print start line to operate the line feed at the step S165. At the step S166, the printing direction is set to the direction in which the printing operation is made from the end portion of the printing area with the shortest distance to the present position of the print head 21. The judgment is made at the step S167 as to whether the head gap is in the widened state. Where the head gap is in the widened state, the operation goes to the step S168, and where the head gap is not in the widened state, the operation goes to the step S169. The narrowing operation of the head gap is made at the step S168. At the step S169, the printing operation of the print data is made. The judgment is made at the step S170 as to whether the segmenting print flag is turned on. Where the segmenting print flag is turned on, the operation goes to the step S171, and where the segmenting print flag is not turned on, this processing ends. The widening operation of the head gap is made at the step S171. The spacing operation of the print head 21 is made toward the inner side of the paper 41 at the step S172. At the step S173, the segmenting print flag is turned off, and the operation returns to the step S29.

In this embodiment, like the above, where the curled paper 41 passes over the paper guide on the downstream side with respect to the printing position, the print head 21 is to be operated above the curling position. Therefore, the paper 41 is prevented from rising in passing over the paper guide to limit the occurrence of the paper travel jam.

Hereinafter, the eighth embodiment according to the invention will be explained. Structured same as from the first to seventh embodiments are assigned same numeral, so the duplicated explanation is omitted. The same operation and effect as from the first to seventh embodiments are also omitted.

Figure 23:
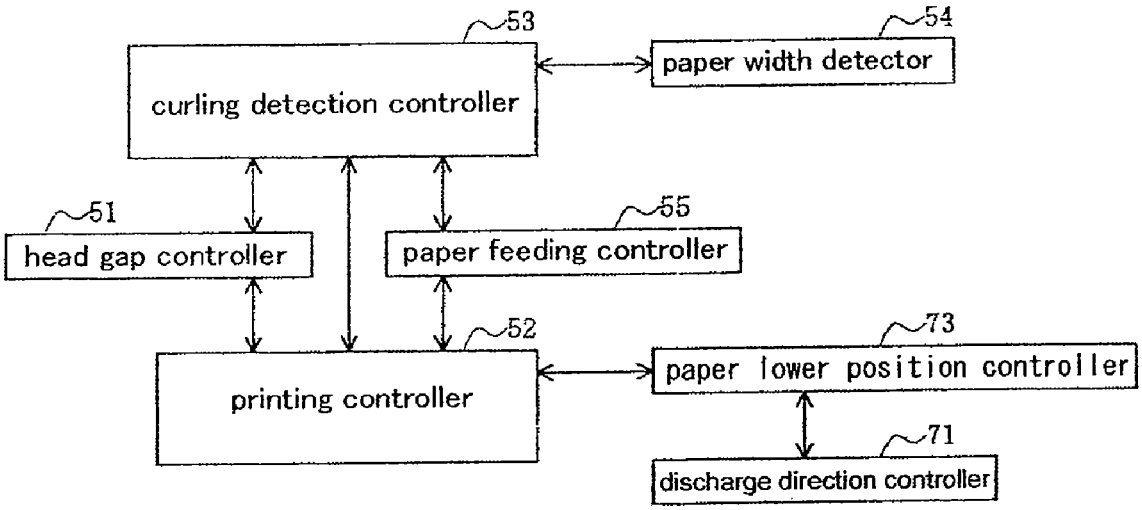
FIG. 23 is a block diagram showing firmware control according to the eighth embodiment of the invention.

FIG. 23 is a block diagram showing firmware control according to the eighth embodiment of the invention.

With the printer apparatus according to this embodiment, a paper lower end position controller 73 for judging and controlling as to whether the lower end position of the paper 41 passes over the paper guide on the upstream side, and the discharge direction controller 71 are newly added, with respect to the structure of the printer apparatus according to the above first embodiment. The rest points regarding the structure are same as the first embodiment, so the explanation is omitted.

Operation of the printer apparatus according to this embodiment will be explained next. Herein, the operation of the curling detection controller 53 is same as the first embodiment to be omitted explaining while the printing controller 52 will be explained.

Figure 24:
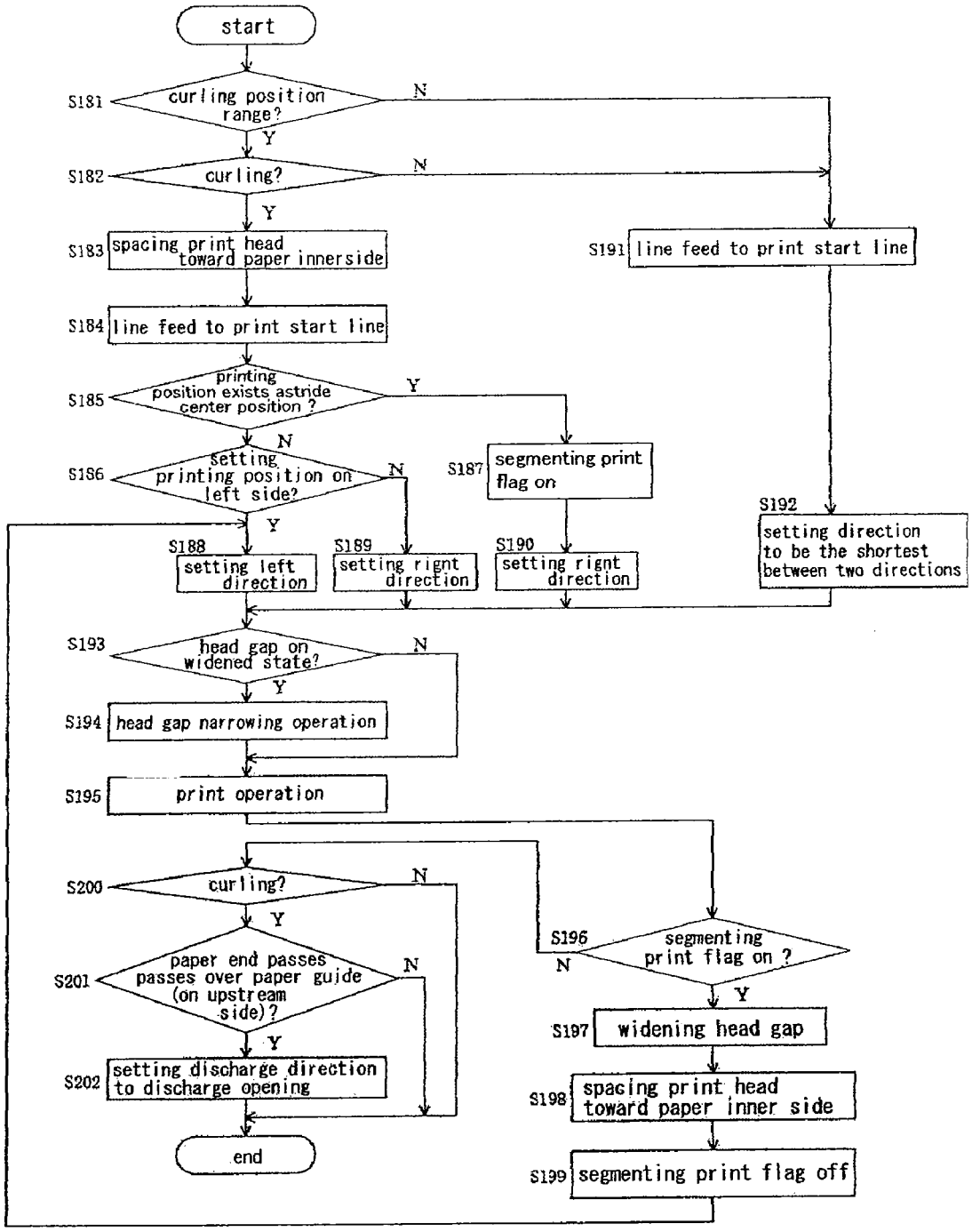
FIG. 24 is a flow chart showing operation of a printing controller according to the eighth embodiment of the invention.

FIG. 24 is a flow chart showing operation of a printing controller according to the eighth embodiment of the invention.

Herein, the operation until printing of the print data is same as the first embodiment, so the explanation is omitted. Subsequently, the judgment is made as to whether the segmenting print flag is turned on. Where the segmenting print flag is turned on, the head gap is made in the widened state, and the spacing operation of the print head 21 is made toward the inner side of the paper 41. The segmenting print flag is then turned off, so the printing direction is set to left, and the subsequent operation returns to a step to make the printing operation. After the operation of the head gap, the printing operation is made from the center portion toward the left end portion of the paper 41. The printing operation is then made over because the segmenting print flag is turned off. Where the segmenting print flag is not turned on, the judgment is made as to whether the paper 41 is curled. Where the paper 41 is not curled, the printing operation ends. Where the paper 41 is curled, the judgment is made by the paper lower position controller 73 as to whether the lower end position of the paper 41 passes over the paper guide on the upstream with respect to the printing position after the printing and the line feed operations. Where the present lower end position of the paper 41 does not pass over the paper guide, this processing ends. Where the present lower end position of the paper 41 passes over the paper guide, the discharge direction is temporally set to the discharge opening at the back side by the discharge direction controller 71. Furthermore, in a case of an automatic paper discharge due to an exceeded lower end of the paper 41, or where the host apparatus, not shown, instructs on a discharge specification command, the discharge direction is also set to the discharge opening at the back side.

A flow chart will be hereinafter explained. At the step S181, the judgment is made as to whether the position of the print data is situated within the range of the curling position. Where the position of the print data is situated within the range of the curling position, the operation goes to the step S182, and where the position of the print data is situated out of the range of the curling position, the operation goes to the step S191. The judgment is made at the step S182 as to whether the paper 41 is curled. Where the paper 41 is curled, the operation goes to the step S183, and where the paper 41 is not curled, the operation goes to the step S191. At the step 183, the spacing operation of the print head 21 is made up to the center position of the inside of the paper 41. The paper 41 is conveyed up to the print start line to operate the line feed at the step S184.

The judgment is made at the step S185 as to whether the printing position exists astride the center portion of the paper 41. Where the printing position does not exist astride the center portion of the paper 41, the operation goes to the step S186, and where the printing position exists astride the center portion of the paper 41, the operation goes to the step S187. The judgment is made at the step S186 as to whether the printing position is situated at the left end side. Where the printing position is situated at the left end side, the operation goes to the step S188, and where the printing position is not situated at the left end side, the operation goes to the step S189. The segmenting print flag is turned on at the step S187. The printing direction is set to left at the step S188. The printing direction is set to right at the step S189. The printing direction is set to right at the step S190. The paper 41 is conveyed up to the print start line to operate the line feed at the step S191. At the step S192, the printing direction is set to the direction in which the printing operation is made from the end portion of the printing area with the shortest distance to the present position of the print head 21. The judgment is made at the step S193 as to whether the head gap is in the widened state. Where the head gap is in the widened state, the operation goes to the step S194, and where the head gap is not in the widened state, the operation goes to the step S195. The narrowing operation of the head gap is made at the step S194. At the step S195, the printing operation of the print data is made. The judgment is made at the step S196 as to whether the segmenting print flag is turned on. Where the segmenting print flag is turned on, the operation goes to the step S197, and where the segmenting print flag is not turned on, the operation goes to the step S200. The widening operation of the head gap is made at the step S197. The spacing operation of the print head 21 is made toward the inner side of the paper 41 at the step S198. At the step S199, the segmenting print flag is turned off, and the operation returns to the step S188. The judgment is made at the step S200 as to whether the paper 41 is curled. Where the paper 41 is curled, the operation goes to the step S201, and where the paper 41 is not curled, this processing ends. The judgment is made at the step S201 as to whether the lower end of the paper 41 passes over the paper guide on the upstream with respect to the printing position. Where the lower end of the paper 41 passes over the paper guide on the upstream with respect to the printing position, the operation goes to the step S202. Where the lower end of the paper 41 does not pass over the paper guide on the upstream with respect to the printing position, this processing ends. At the step S202, the discharge direction is set to the paper discharge opening, and this processing ends.

In this embodiment, like the above, in a case of the printer apparatus having the structure enable to set the discharge direction of the paper 41 to either the paper supply opening at the front side or the discharge opening at the back side, when the curling status is detected at the upper end of the paper 41, a high probability of curling of the lower end position of the paper 41 depending on a thickness and a quality of the paper 41, is taken into consideration. It is to be noted that the occurrence of the paper travel jam can be prevented because the lower end of the paper 41 contacts with the paper guide on the downstream side with respect to the printing position during discharging of the paper 41.

Hereinafter, the ninth embodiment according to the invention will be explained. Structured same as from the first to eighth embodiments is assigned same numeral, so the explanation is omitted. The same operation and effect as from the first to eighth embodiments are also omitted.

Figure 25:
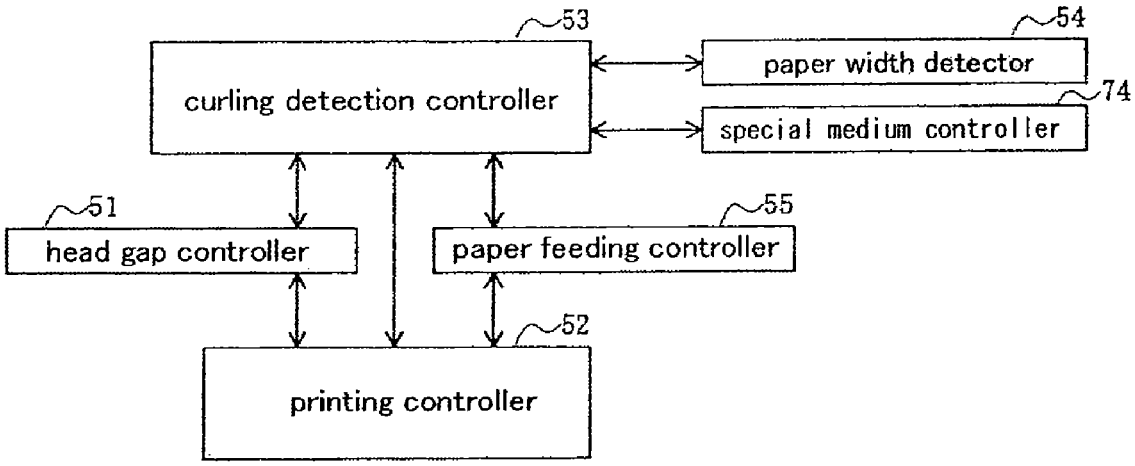
FIG. 25 is the block diagram showing firmware control according to the ninth embodiment of the invention.

FIG. 25 is the block diagram showing firmware control according to the ninth embodiment of the invention.

With the printer apparatus according to this embodiment, a special medium controller 74 is newly added, with respect to the structure of the printer apparatus according to the above first embodiment. The rest points regarding the structure are same as the first embodiment, so the explanation is omitted.

Operation of the printer apparatus according to this embodiment will be explained next. Herein, the operation of the printing controller 52 is same as the first embodiment to be omitted explaining while the curling detection controller 53 will be explained.

Figure 26:
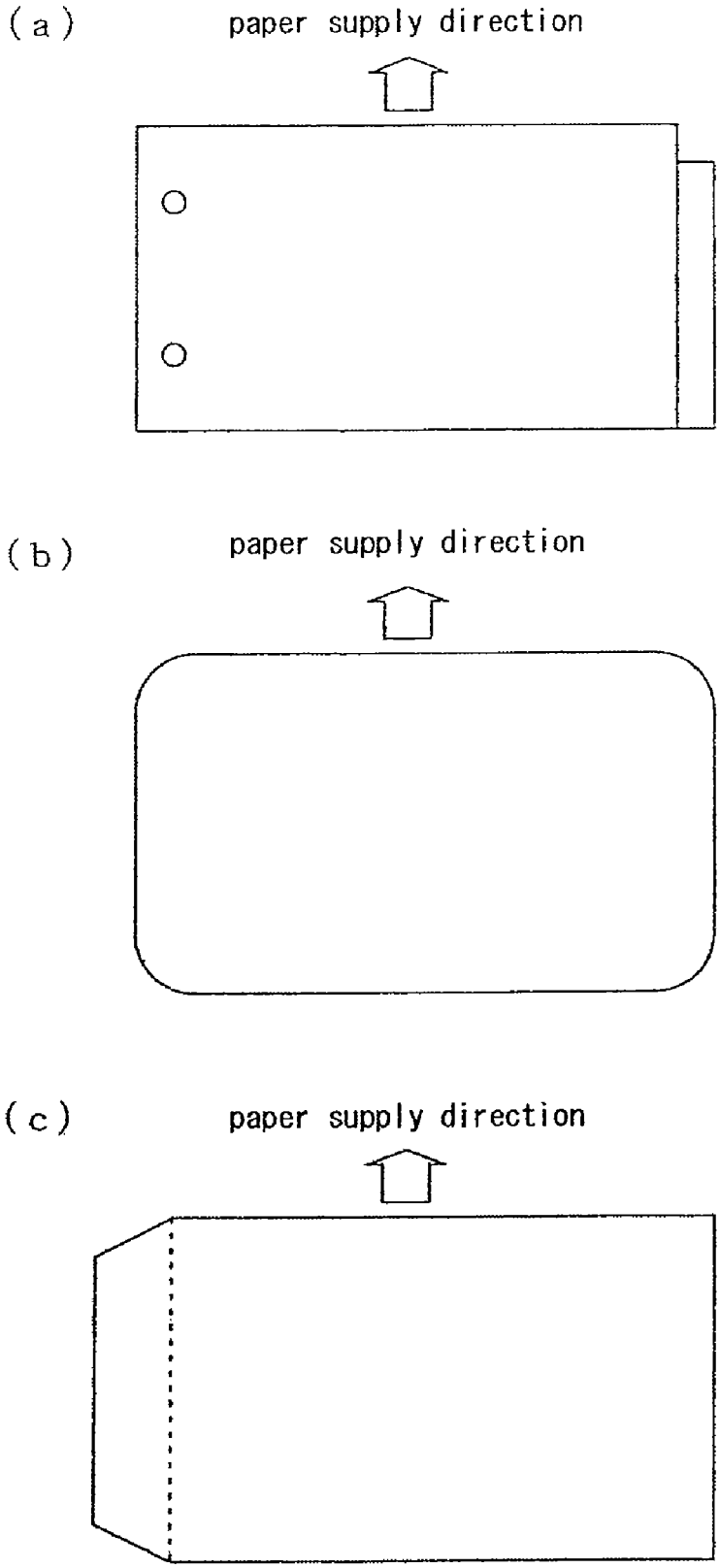
FIG. 26 is a view showing an example of a special medium according to the ninth embodiment of the invention.
Figure 27:
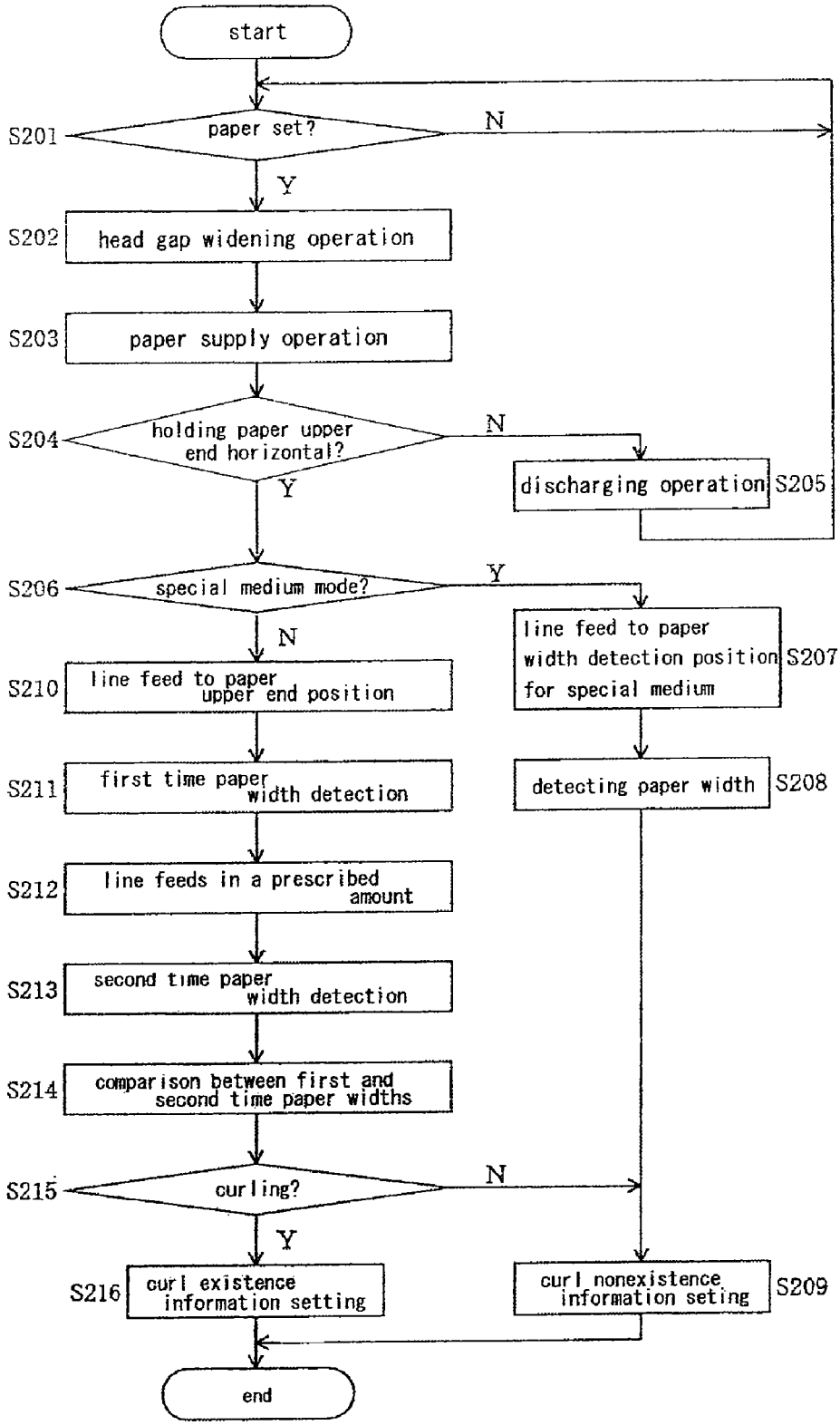
FIG. 27 is a flow chart showing operation of a curling detection controller according to the ninth embodiment of the invention.

FIG. 26 is a view showing an example of a special medium according to the ninth embodiment of the invention.

Herein, operation until making the judgment as to whether the upper end of the paper 41 is horizontally supplied, is same as the first embodiment, so the explanation is omitted. Where the paper 41 is horizontally supplied, lines are fed on the paper 41 to supply the paper 41 up to a lower side position of the paper width sensor 32. Where the upper end of the paper 41 is not in a widthwise condition because of, e.g., supplying of the paper 41 as skewed, the discharging of the paper 41 is operated, and the state of the paper 41 in the skewed condition is made displayed at the display screen of the LCD 49 to inform the user.

Where the paper 41 is horizontally supplied, the judgment is made as to whether the mode designated in the set-up mode or with the control panel is a special medium mode. It is to be noted that the special medium is defined as a medium having an upper end corner portion in an out of square shape, e.g., a slip used in parcel delivery service, as shown in FIG. 26 (*a*), a passbook or a card shown in FIG. 26 (*b*), an envelopment as shown in FIG. 26 (*c*), and so on.

In a case of the special medium mode, the special medium controller 74 conveys the paper 41 up to the paper width detection position for the special medium mode already set in the set-up mode. When printing the medium in a special shape, it is preferable that the user preliminarily registers and sets the paper width detection position of medium-by-medium in the set-up mode or with the control panel. Subsequently, the paper width detection operation for the special medium mode is made to detect the left and right end positions respectively of the paper 41. The status of curl nonexistence is then set in the paper curling status information, and this processing ends.

Where the medium is not in the special mode, the paper 41 is conveyed up to the paper width sensor 32 after feeding lines. The subsequent operation is same as the first embodiment, so the explanation is omitted.

Hereinafter, a flow chart will be explained. At the step S201, the judgment is made as to whether the paper 41 is set on the table sensor 34. Where the paper 41 is set on the table sensor 34, the operation goes to the step S202, and where the paper 41 is not set on the table sensor 34, the operation stays standby state. The widening operation of the head gap is done at the step S202. The paper supply operation is done at the step S203. At the step S204, the judgment is made as to whether the upper end of the paper 41 is horizontally supplied. Where the upper end of the paper 41 is horizontally supplied, the operation goes to the step S206, and where the paper 41 is not horizontally supplied, the operation goes to the step S205. The discharging operation is done at the step S205. The judgment is made at the step S206 as to whether the medium is in the special mode. Where the medium is in the special mode, the operation goes to the step S207, and where the medium is not in the special mode, the operation goes to the step S210. At the step S207, the paper 41 is conveyed up to the paper width detection position for the special medium mode to operate the line feed. At the step S208, the paper width detection operation for the special medium mode is made. At the step S209, the status that the paper 41 is not curled is set, and this processing ends. The feed line is operated up to the upper end position of the paper 41 at the step S210. The paper width detection operation at the first time is operated at the step S211. The line feeds in the prescribed amount are operated at the step S212. The paper width detection operation at the second time is operated at the step S213. The paper widths at the first and second times respectively are compared at the step S214. At the step S215, the judgment is made as to whether either the left end or the right end of the paper 41 is curled. Where either the left end or the right end of the paper 41 is curled, the operation goes to the step S216, and where neither the left end nor the right end of the paper 41 is curled, the operation goes to the step S209. At the step S216, the status that the paper 41 is curled is set, and this processing ends.

In this embodiment, like the above, when printing the paper 41 as the medium in a special shape, the wrong detection of the curling status can be prevented.

This invention is not limited to the above described embodiments but is able to be deformed variously corresponding to a purpose of this invention, and these deformations are not eliminated from the range of this invention.

As described above in detail, according to this invention, with the method for processing the medium, the first medium width is detected at the first position of the medium, while the second medium width is detected at the second position of the medium, and the width difference is detected in comparison between the detected first and second medium widths.

In this case, folding of the medium can be detected to make printing suitably corresponding to folding of the medium.

The foregoing description of a preferred embodiment of the invention has been presented for purposes of illustration and description, and is not intended to be exhaustive or to limit the invention to the precise form disclosed. The description was selected to best explain the principles of the invention and practical application of these principals to enable others skilled in the art to best utilize the invention in various embodiments and various modifications as are suited to the particular use contemplated. It is intended that the scope of the invention should not be limited by the specification, but be defined by the claims set forth below.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An image processing apparatus comprising:

a medium feeding passage for conveying a medium;

an image processing portion for performing an image processing of the medium including a print head which performs printing on the medium;

a gap adjusting mechanism which widens a space between the medium and the print head;

a detector for detecting first left end and right end positions of the medium at a first position in a medium conveyance direction of the medium and detecting second left end and right end positions of the medium at a second position in the medium conveyance direction of the medium after a conveyance of the medium by a predetermined distance subsequent to the detection of said first left end and right end positions, a medium guide arranged on a downstream side in the medium conveyance direction with respect to the image processing portion, wherein the second left end and right end positions are detected before a front end of the medium reaches the medium guide, and a comparator for comparing the first left end position with the second left end position and comparing the first right end position with the second right end position, wherein a predetermined processing is made according to the compared results from the comparator, wherein if the compared result from the comparator is greater than a predetermined value, the medium is discharged with the spacing of the print head widened.

2. The image processing apparatus according to claim 1, wherein the medium is discharged without executing printing.

3. The image processing apparatus according to claim 1, wherein the medium is discharged on a downstream side of the medium feeding passage.

4. The image processing apparatus according to claim 1, wherein the medium is discharged on an upstream side of the medium feeding passage.

5. The image processing apparatus according to claim 4, wherein the upstream side of the medium feeding passage is the side at which the medium is supplied.

6. The image processing apparatus according to claim 1, further comprising a display means, wherein a message is displayed on the display means after the medium is discharged.

7. The image processing apparatus according to claim 1, further comprising a setting means for setting the medium discharge direction, wherein the medium is discharged to a direction set by the setting means.

8. The image processing apparatus according to claim 1, wherein if the compared result is less than a predetermined value, the medium is discharged on a downstream side of the medium feeding passage after an image is printed, and wherein the compared result is equal to or greater than a predetermined value, the medium is discharged on an upstream side of the medium feeding passage without printing operation.

* * * * *